US008297251B2

(12) United States Patent
Asaya

(10) Patent No.: US 8,297,251 B2
(45) Date of Patent: Oct. 30, 2012

(54) LUBRICANT STRUCTURE OF ENGINE

(75) Inventor: Norikazu Asaya, Akashi (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 520 days.

(21) Appl. No.: 12/504,037

(22) Filed: Jul. 16, 2009

(65) Prior Publication Data

US 2010/0012074 A1 Jan. 21, 2010

(30) Foreign Application Priority Data

Jul. 17, 2008 (JP) ..... P2008-185945
Aug. 26, 2008 (JP) ..... P2008-216384
Aug. 26, 2008 (JP) ..... P2008-216385
Sep. 16, 2008 (JP) ..... P2008-236420

(51) Int. Cl.
*F01M 3/04* (2006.01)

(52) U.S. Cl. ..... 123/196 A; 123/196 CP; 123/196 R

(58) Field of Classification Search ..... 123/196 A, 123/196 R, 196 CP; 184/6.24
See application file for complete search history.

(56) References Cited

U.S. PATENT DOCUMENTS

| | | | | |
|---|---|---|---|---|
| 3,990,489 | A * | 11/1976 | Ruter | 141/98 |
| 5,522,476 | A * | 6/1996 | Holman | 184/6.12 |
| 6,112,726 | A * | 9/2000 | Saito et al. | 123/509 |
| 6,442,726 | B1 * | 8/2002 | Knefel | 714/763 |
| 6,823,829 | B1 * | 11/2004 | Kawamoto et al. | 123/196 R |
| 7,165,651 | B2 * | 1/2007 | Hiraga | 184/6.12 |
| 7,178,498 | B2 * | 2/2007 | Takeuchi | 123/196 R |
| 8,042,672 | B2 * | 10/2011 | Grethel et al. | 192/48.611 |
| 2005/0076731 | A1 * | 4/2005 | Hiraga | 74/333 |

FOREIGN PATENT DOCUMENTS

| | | | |
|---|---|---|---|
| DE | 3714087 | A * | 11/1987 |
| JP | 6-288466 | | 10/1994 |
| JP | 8-135419 | | 5/1996 |
| JP | 8-246828 | | 9/1996 |
| JP | 2000-199414 | | 7/2000 |
| JP | 2000-283271 | | 10/2000 |
| JP | 2003-129814 | | 5/2003 |
| JP | 2003-293722 | | 10/2003 |
| JP | 2005-282568 | | 10/2005 |
| JP | 2006-291924 | | 10/2006 |
| JP | 2007-9738 | | 1/2007 |
| JP | 2007-71065 | | 3/2007 |
| JP | 2007-198311 | | 8/2007 |
| JP | 2008-25669 | | 2/2008 |

* cited by examiner

*Primary Examiner* — Noah Kamen
*Assistant Examiner* — Long T Tran
(74) *Attorney, Agent, or Firm* — Wenderoth, Lind & Ponack, LLP

(57) ABSTRACT

A lubricant structure of an engine capable of easily and compactly attaching and detaching primary oil filters connected to oil intake sides of two oil pumps to and from a crank case. A power transmission chamber in the crank case dually divided in a crankshaft direction is an oil reserving portion. The lubricant structure includes a first oil pump for pressure-feeding oil of the oil reserving portion to a lubricant point, a second oil pump for returning the oil returned to the crank chamber to the oil reserving portion, and first and second oil filters connected to the oil intake sides of the oil pumps. The first oil filter is inserted from one of left and right crank case members, the second oil filter is inserted from the other crank case member, and both the oil filters are closed by oil filter caps.

19 Claims, 16 Drawing Sheets

83
41c
41
84
41a
41b
82
1b(1)
48
45
106
87
110
108
128
132
1a(1)
43
LEFT
RIGHT
58
59
2
6b
81
42
80
42d
36
9
131
8
42c
42a
42b
41d

LUBRICANT STRUCTURE OF ENGINE

BACKGROUND OF THE INVENTION

1. Field of the Invention

The present invention relates to a lubricant structure of an engine, particularly to a lubricant structure suitable for an engine for maintaining a dry state so that oil is not gathered in a crank chamber while driving and also utilizing a power transmission chamber in a crank case as an oil reserving or gathering portion, which is a so-called semi-dry sump type engine.

2. Description of the Prior Art

Prior Art

Unlike a dry sump type engine, there is no need for providing a separate oil tank for a semi-dry sump type engine. Therefore, it is possible to save cost and arrangement space for the oil tank. It should be noted that with another oil pan type engine, there is a problem that a lower side of the engine protrudes and hence engine height is elongated.

In general, the semi-dry sump type engine is provided with two oil pumps. One is a first oil pump for pressure-feeding oil from an oil reserving portion to a plurality of lubricant points of the engine, which is a so-called feed pump. The other is a second oil pump for pumping the oil returned from the lubricant points to a crank chamber and the like up to the oil reserving portion, which is a so-called a scavenging pump. Primary oil filters are respectively connected to oil intake or suction sides of the two oil pumps.

FIG. 15 is a conventional semi-dry sump type engine disclosed in Japanese Patent Laying-Open No. 2007-9738. An arrangement structure of primary oil filters of a feed pump and a scavenging pump in this engine will be described. An oil pan 301 which is a separate member from a crank case 300 is attached to a lower surface of the crank case 300. A funnel-shaped primary oil filter 303 communicating with an oil intake side of the feed pump (not shown) and a primary oil filter 304 communicating with an oil intake side of the scavenging pump (not shown) are arranged in this oil pan 301. It should be noted that the crank case 300 has dually divided into upper and lower members, and only the lower crank case member is schematically shown in the drawing.

In a case where the primary oil filters 303 and 304 are exchanged, after the oil pan 301 attached to a lower part of the crank case 300 by a bolt or the like (not shown) is removed, the primary oil filters 303 and 304 are removed from the oil pan 301, and then new primary oil filters or the cleaned primary oil filters are attached respectively.

In a conventional semi-dry sump type engine disclosed in Japanese Patent Laying-Open No. 1994-288466 and Japanese Patent Laying-Open No. 1996-135419, an intake portion of a scavenging pump directly communicates with a crank chamber, and oil dropping down into the crank chamber is suctioned from an oil intake port in a lower end and discharged to a power transmission chamber so as to maintain an inside of the crank chamber in a dry state.

Further, FIG. 16 shows a detailed description for oil pumps and oil passages of said Prior Art, Japanese Patent Laying-Open No. 2007-9738. However, reference numerals are refurbished. In FIG. 16, a crank case 401 is dually divided into upper and lower crank case members 401*a* and 401*b*, and separated by a division wall 402 into a crank chamber 403 of a front part and a power transmission chamber 404 of a rear part. An oil pan 405 is attached to a lower surface of the lower crank case member 401*b*. A second oil pump (a scavenging pump) 412 for pumping oil gathered in the crank chamber 403 up to the power transmission chamber 404 and a first oil pump (a feed pump not shown) for pressure-feeding the oil gathered in a lower part of the power transmission chamber 404 to a lubricant point are arranged in parallel in a lower end of the division wall 402.

The second oil pump 412 has an oil discharge port 412*a* directly opening in the power transmission chamber 404, suctions the oil gathered in a lower space portion 403*a* of the crank chamber 403 via a filtering instrument 413 and an oil passage 414 on an intake side, and directly discharges the oil from the oil discharge port 412*a* to an oil reserving portion 404*a* of the power transmission chamber 404.

It should be noted that a part of the oil discharged by the first oil pump is supplied to a cam shaft and a rocker arm and the like arranged in a rocker arm chamber on an upper surface of a cylinder head. In general, the oil already used in the rocker arm chamber passes through a cam chain tunnel, a generator chamber, a clutch chamber or the crank chamber, and returns to the lower space portion 403*a*. The oil is returned to the oil reserving portion 404*a* in the lower part of the power transmission chamber 404 by the second oil pump 412 together with the oil returned from other lubricant points.

Problems of Prior Arts

As a structure of a crank case of an engine, in addition to the structure divided into the upper and lower members as in FIG. 15, there is a structure divided into left and right members in a crankshaft direction, that is, a structure divided in a left and right direction. In any structure, in a case where the oil pan which is the separate member is attached to the lower surface of the crank case as in FIG. 15, it is possible to easily exchange both the primary oil filters by removing the oil pan from the crank case. However, in order to simplify and compactify the structure of the crank case, in a semi-dry sump type engine not provided with an oil pan which is a separate member, the crank case itself has to be divided into upper and lower or left and right members. It is troublesome to perform an exchange work of the primary oil filters, and hence workability at the time of exchange is lowered. Particularly, in a case where the crank case divided into the left and right members (in the crankshaft direction) is provided, the crank case cannot be split unless a crankshaft, and transmission output and input shafts are removed from at least one of the crank case members. Therefore, the workability at the time of exchange of the primary oil filters is extremely lowered.

As shown in Japanese Patent Laying-Open No. 1994-288466 and Japanese Patent Laying-Open No. 1996-135419, the structure of directly suctioning the oil from the inside of the crank chamber by the scavenging pump has the following problems.

(1) A pressure change is repeated in the crank chamber in accordance with a volumetric change by raising and lowering a piston. However, with the structure of directly suctioning the oil from the crank chamber, the pressure change in the engine influences over suctioning force of the scavenging pump, and a suctioning amount of the scavenging pump is changed. Therefore, it is not possible to sufficiently utilize a suctioning ability of the oil pump.

(2) Since the oil in a bottom part of the crank chamber is rolled up by rotation of a crank web, agitation resistance of the crankshaft is increased. Further, since bubbles are generated in the oil, air entrainment is caused in the scavenging pump, and hence pump efficiency is lowered.

In the structure shown in FIG. 16, a lot of bubbles are contained in the oil suctioned from the lower space portion 403*a* of the crank chamber 403 by the second oil pump 412. When the oil containing a lot of bubbles is gathered or collected in the oil reserving portion 404*a* of the power transmission chamber 404, in a case where the oil in the oil reserving portion 404*a* is suctioned by the first oil pump, the air entrainment is caused, the pump efficiency is lowered and supply efficiency of the oil to the lubricant point is also lowered. Therefore, the oil already used in the lubricant point is desirably returned to the power transmission chamber 404 without passing through the crank chamber and the second oil pump as much as possible.

SUMMARY OF THE INVENTION

It is an object of the present invention to provide a lubricant structure of a semi-dry sump type engine having a crank case divided in a crankshaft direction, that is, a lubricant structure of an engine capable of easily exchanging primary oil filters connected to oil intake sides of two oil pumps without splitting the crank case or other members. One of other objects is to arrange both the primary oil filters compactly so as to compactify and further standardize the engine itself.

One of other objects of the present invention is to provide a lubricant structure of an engine capable of efficiently returning oil gathered in a crank chamber to a side of a power transmission chamber without causing air entrainment and effectively utilizing lower space of the crank chamber for oil piping.

One of other objects of the present invention is to provide a lubricant structure of a semi-dry sump V-type engine in which oil already used for lubricating a cam shaft and the like on an upper surface of a cylinder head is directly returned to an oil reserving portion of a power transmission chamber so as to prevent air entrainment of a first oil pump for pressure-feeding the oil from the power transmission chamber to a lubricant point and improve pump efficiency and oil supply efficiency.

Further, one of other objects of the present invention is to provide a lubricant structure of a semi-dry sump type engine in which oil pumped up by a second oil pump from a crank chamber is returned to a power transmission chamber in an air bleeding state so as to prevent air entrainment of a first oil pump for pressure-feeding the oil from the power transmission chamber to a lubricant point and improve pump efficiency and oil supply efficiency.

In order to achieve the above objects, a first basic feature of the present invention is a lubricant structure of an engine, including: a power transmission chamber formed as an oil reserving portion, in a crank case divided in a crankshaft direction, i.e. right and left direction; a first oil pump for pressure-feeding oil of the oil reserving portion to a plural of lubricant points; a second oil pump for returning the oil returned to a crank chamber to the power transmission chamber; a first oil filter connected to an intake side of the first oil pump; and a second oil filter connected to an intake side of the second oil pump, wherein oil filter attachment ports are respectively formed in crank case members forming the crank case on both sides in the crankshaft direction, the first oil filter is inserted into the crank case from the oil filter attachment port of one of the crank case members, the second oil filter is inserted into the crank case from the oil filter attachment port of the other crank case member, and the oil filter attachment ports are respectively closed by oil filter caps.

According to the above configuration, (1) both the primary oil filters can be attached and removed without splitting the crank case and exchange and maintenance works of the primary oil filters are easily performed.

(2) Both the oil filters are separately attached from both sides in the crankshaft direction, that is, from left and right sides. Therefore, even when both the oil filters are arranged close to each other, arrangement space for the oil filter caps is easily ensured and both the oil filters can be compactly arranged. That is, the arrangement space for the oil filter caps is easily ensured and both the oil filters can be compactly arranged so as to be close to each other.

(3) Oil passages communicating with the oil filters can be respectively distributed to the crank case members. Therefore, it is possible to ensure large formation space of the oil passages.

In the lubricant structure of the engine of the present invention, preferably, the first oil filter and the second oil filter are formed in a substantially same shape.

According to the above configuration, since common parts can be used for the first oil filter and the second oil filter, there is no need for distinguishing the above parts at the time of assembling. Therefore, it is no more troublesome to manufacture, manage, assemble and perform maintenance of the oil filters. It is also possible to standardize manufacture of the oil filters and reduce cost.

In the lubricant structure of the engine of the present invention, preferably, both the oil filters are formed in a substantially cylindrical shape.

According to the above configuration, (1) in comparison to a case where tabular oil filters are attached, it is possible to easily attach the oil filters without consideration to rotation positions around cylindrical cores of the oil filters.

(2) In general, the substantially cylindrical oil filter takes the oil in from an outer periphery and discharges the oil from a front end of an inner periphery in a longitudinal direction. Therefore, it is possible to easily achieve communication between outlet portions of front ends in the longitudinal direction of the primary oil filters and oil passages formed in the crank case member.

In the lubricant structure of the engine of the present invention provided with the substantially cylindrical oil filters, preferably, substantially-cylindrical first and second oil filter retaining portions respectively communicating with the oil filter attachment ports are formed integrally with the crank case in the crank case, a first intake port opening in a lower end of the oil reserving portion is formed in the first oil filter retaining portion for retaining the first oil filter, and a second intake port opening in a lower end of the crank chamber is formed in the second oil filter retaining portion for retaining the second oil filter. The first oil filter retaining portion and the second oil filter retaining portion are formed so that a longitudinal direction thereof is substantially parallel to the crankshaft, and the first oil filter retaining portion is arranged so as to be placed on a side of the oil reserving portion relative to the second oil filter retaining portion.

According to the above configuration, by a casting method such as die-casting or low-pressure casting, it is possible to easily form the oil filter retaining portions and the intake ports at the time of molding the crank case, and an insertion work of the oil filters is easily performed. Moreover, the first oil filter retaining portion is arranged on the side of the oil reserving portion relative to the second oil filter retaining portion. Therefore, only by opening the intake ports in peripheral walls of both the oil filter retaining portions, it is possible to easily achieve communication between the oil filter retaining portions and the oil reserving portion and the crank chamber.

In any of the lubricant structure of the engine of the present invention, preferably, the first oil pump and the second oil pump are attached to a common pump shaft which is substantially parallel to the crankshaft in the crankshaft direction, and the first and second oil filters are arranged at substantially lower positions of both the oil pumps.

According to the above configuration, it is possible to compactly form a connection (communication) structure of the oil pumps and the oil filters.

A second feature of the present invention relates to a shape of the crank chamber in addition to the first feature and has the following configuration.

The crank chamber is partitioned by a partition wall into a crankshaft housing portion for housing the crankshaft, and an oil retrieving portion located under the crankshaft housing portion communicating with an intake portion of the second oil pump, a communication hole for achieving communication between the crankshaft housing portion and the oil retrieving portion so as to distribute the oil formed in the partition wall, and an oil pipe for pressure-feeding the oil discharged from the first oil pump to a secondary oil filter provided in the crank case is arranged in the oil retrieving portion.

According to the above configuration, after the oil gathered in the crank chamber is once in a static state in the oil retrieving portion, the oil is discharged to a side of the power transmission chamber by the second oil pump. Therefore, the air entrainment is prevented in the second oil pump and the pump efficiency of the second oil pump is improved. Accordingly, bubbles in the oil discharged to the power transmission chamber can be decreased and the oil supply efficiency to the lubricant points by the first oil pump is improved.

Moreover, the lower space of the crank chamber is utilized as the oil retrieving portion and also utilized as piping space by arranging the oil pipe in the oil retrieving portion. Therefore, it is possible to effectively utilize dead space in the crank chamber.

In the lubricant structure of the engine having the second feature, preferably, an end of the oil pipe in a longitudinal direction has a tubular joint substantially orthogonal to the longitudinal direction of the oil pipe, and the joint is fitted and connected to an oil port part formed in a side wall portion of the oil retrieving portion.

According to the above configuration, it is possible to easily attach the end of the oil pipe from the side of the crank case.

In the lubricant structure of the engine having the second feature, preferably, the oil pipe has the joints in both ends in the longitudinal direction, and both the joints are connected to the oil port parts formed in one of the dually-divided crank case members.

According to the above configuration, it is possible to attach both the ends of the oil pipe to one crank case member from one side in the crankshaft direction, and an assembling work of the oil pipe is more easily performed.

In the lubricant structure of the engine having the second feature, preferably, the secondary oil filter is arranged in a lower part of a front end of the crank case.

According to the above configuration, it is possible to arrange the oil pipe in the oil reserving portion in a substantially straight and short manner so as to compactify the oil pipe and also reduce resistance of the oil against passages.

In the lubricant structure of the engine having the second feature, preferably, the communication hole opens so as to face oil flow moving over an upper surface of the partition wall by rotation of the crankshaft.

According to the above configuration, the oil flowing through an inside of the crankshaft housing portion can be promptly discharged to the oil reserving portion without bubbling. Therefore, it is possible to prevent a decrease in an output by oil agitation. The secondary oil filter is arranged not on a side surface but on an end surface of the crank case. Therefore, it is possible to arrange the secondary oil filter while avoiding interference with other parts and layout freedom for various parts around the crank case is increased.

In the lubricant structure of the engine having the second feature, preferably, an oil intake port communicating with the intake side of the second oil pump opens in the oil retrieving portion, and the oil intake port is arranged in or in a vicinity of an end of the oil retrieving portion and the communication hole is arranged in or in a vicinity of the other end of the oil retrieving portion.

According to the above configuration, it is possible to increase a distance between the communication hole and the oil intake port communicating with the intake side of the second oil pump as much as possible.

A third feature of the present invention relates to a returning route of the oil in addition to the first feature and has the following configuration.

The crank case combines front and rear cylinders arranged in a V shape, an oil discharge port is formed on an upper surface of a cylinder head of the rear cylinder, and an oil returning route ranging from the oil discharge port to the power transmission chamber without passing through an inside of the crank chamber and the second oil pump is formed in the cylinder head, the cylinder and the crank case.

According to the above configuration, the oil already used for cooling and lubricating the cam shaft and the like on the upper surface of the cylinder head is directly returned to the power transmission chamber without passing through the inside of the crank chamber and the second oil pump (a so-called scavenging pump). Therefore, an influence of the second oil pump is not received in a middle of returning to the power transmission chamber, and air mixture into the oil can be prevented. Thereby, it is possible to prevent or reduce the air entrainment by the first oil pump.

The oil is returned to the power transmission chamber without passing through the second oil pump. Therefore, it is possible to downsize the second oil pump.

In the lubricant structure of the V-type engine having the third feature, preferably, the oil discharge port is arranged on an opposite side of a side where a cam chain tunnel of the rear cylinder is formed in the crankshaft direction.

According to the above configuration, the oil is discharged from the oil discharge port on the opposite side in addition to oil discharge from the cam chain tunnel. Therefore, it is possible to efficiently discharge the oil over the entire upper surface of the cylinder head and improve oil discharge efficiency.

In the lubricant structure of the V-type engine having the third feature, preferably, a guide for guiding the oil of the cylinder head to the oil discharge port is formed on the upper surface of the cylinder head of the rear cylinder. The guide is formed in a concave portion or a protruding shape for example.

According to the above configuration, it is possible to improve a discharge amount and speed of the oil from the oil discharge port, and the oil discharge efficiency is improved.

In a case where the V-type engine having the third feature is installed in a two-wheeled motor vehicle, preferably, the oil discharge port is formed in an end on a side where a vehicle body is inclined when the vehicle body is supported by a side stand.

In a state that the vehicle body is supported by the side stand, the oil on the upper surface of the cylinder head is not easily discharged from the cam chain tunnel. However, the oil on the upper surface of the cylinder head is collected on a side of the oil discharge port, and it is possible to promptly discharge the oil from the oil discharge port.

In the lubricant structure of the V-type engine having the third feature, preferably, a relief valve connected to a discharge side of the first oil pump is arranged in the power transmission chamber.

According to the above configuration, the oil overflowing from the relief valve can be directly returned to the power transmission chamber. Therefore, the oil is quickly returned to the power transmission chamber. Thereby, it is possible to improve an effect of preventing air entrainment of the first oil pump.

A fourth feature of the present invention relates to a returning route of the oil in addition to the first feature and has the following configuration.

The power transmission chamber is isolated from the crank chamber by a first division wall, a second division wall is formed in the power transmission chamber so that a gas-liquid separation chamber is formed between the second division wall and the first division wall, an oil inlet communicating with a discharge portion of the second oil pump is formed in the gas-liquid separation chamber, and an oil discharge port for discharging the oil from the gas-liquid separation chamber to the power transmission chamber is formed at a position higher than the oil inlet in the second division wall.

According to the above configuration, the oil pumped up by the second oil pump is not directly discharged to the power transmission chamber but once gathered in the gas-liquid separation chamber and then discharged from the oil discharge port formed in an upper end of the gas-liquid separation chamber to the power transmission chamber. Therefore, it is possible to bleed the air in the oil by leaving the oil in the gas-liquid separation chamber for a fixed time. After that, when the oil of the power transmission chamber is suctioned by the first oil pump, the air entrainment is prevented, and it is possible to improve the pump efficiency and the oil supply efficiency to the lubricant point.

In the semi-dry sump type engine, the existing first division wall for isolating the crank chamber from the power transmission chamber is utilized so as to form the gas-liquid separation chamber. Therefore, it is possible to reduce the number of the parts, easily manufacture the crank case and simplify the crank case.

In the lubricant structure of the engine having the fourth feature, preferably, the gas-liquid separation chamber has a constricted part having a smaller horizontal sectional area in a part from the oil inlet to the oil discharge port on an upper side.

According to the above configuration, the oil in the gas-liquid separation chamber passes through the constricted part in a process of pushing up the oil. Therefore, it is possible to collect a number of small bubbles and hence form large bubbles for example so as to promptly release the air from the oil in the upper end of the gas-liquid separation chamber, and an air bleeding effect is more improved. Since a capacity of the gas-liquid separation chamber is limited, it is possible to limit an oil amount gathered in the gas-liquid separation chamber. Thereby, it is possible to ensure that the oil amount gathered in a lower part of the power transmission chamber is not a predetermined amount or less.

In the lubricant structure of the engine having the fourth feature, the first and second division walls are formed integrally with the crank case, the crank case has a pair of crank case members dually divided in the crankshaft direction, and the oil discharge port is formed on a matching surface between both the crank case members.

According to the above configuration, it is possible to easily form the division walls and the oil discharge port together with the divided crank case members at the time of manufacturing the crank case.

In the lubricant structure of the engine having the fourth feature, preferably, a housing of the second oil pump is formed integrally with the crank case and also formed integrally and continuously with at least a part of the second division wall.

According to the above configuration, it is possible to easily form the housing of the second oil pump together with the crank case at the time of molding the crank case, and moreover to simplify piping ranging from the second oil pump to the gas-liquid separation chamber.

In the lubricant structure of the engine having the fourth feature, preferably, a relief valve is connected to an oil passage on a discharge side of the first oil pump, and a relief route for guiding the oil released from the relief valve to the power transmission chamber is formed.

According to the above configuration, it is possible to return extra oil discharged from the relief valve to the power transmission chamber via the relief route. That is, the extra oil can be returned to the power transmission chamber without passing through the second oil pump. Therefore, it is possible to prevent mixture of the bubbles into the returned oil and contribute to air entrainment prevention of the first oil pump.

In the lubricant structure of the engine having the fourth feature, preferably, an oil intake port opening in the power transmission chamber and communicating with a pump intake port of the first oil pump is formed in a lower end of the power transmission chamber, and the oil intake port opens at a position displaced from a position immediately beneath the second division wall.

According to the above configuration, the oil overflowing from the oil discharge port in the upper end of the gas-liquid separation chamber and flowing into the power transmission chamber along the second division wall is not directly suctioned by the first oil pump. Thereby, it is possible to contribute to the air entrainment prevention of the first oil pump.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

[Embodiment of the Present Invention]

FIGS. 1 to 14 show a semi-dry sump V-type two-cylinder engine for a two-wheeled motor vehicle provided with a lubricant structure according to the present invention. One embodiment of the present invention will be described based on the above drawings. It should be noted that for convenience of description, hereinafter, a traveling direction of a vehicle is defined as a front side of the engine as shown by an arrow in FIG. 1, and a left and right direction seen from a rider (a crankshaft direction) is defined as a left and right direction of the engine.

(Outline of Entire Engine)

Figure 1:
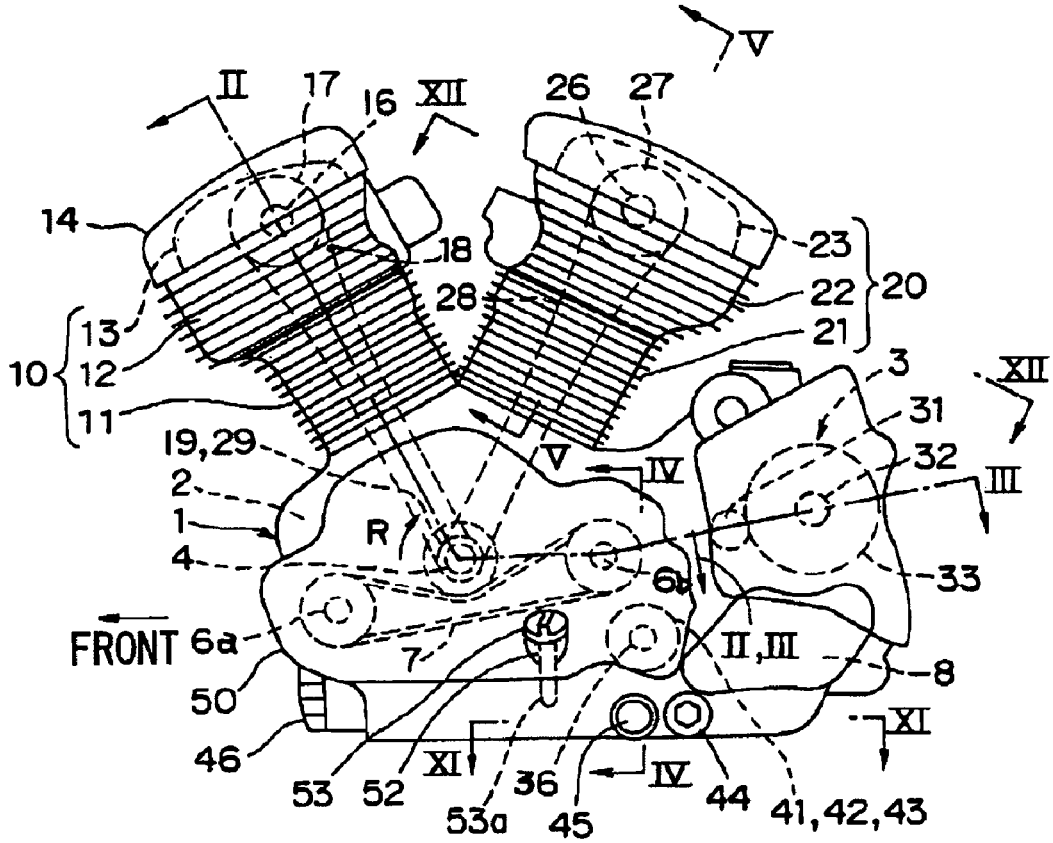
FIG. 1 is a left side schematic view of an engine provided with a lubricant structure according to the present invention.
Figure 2:
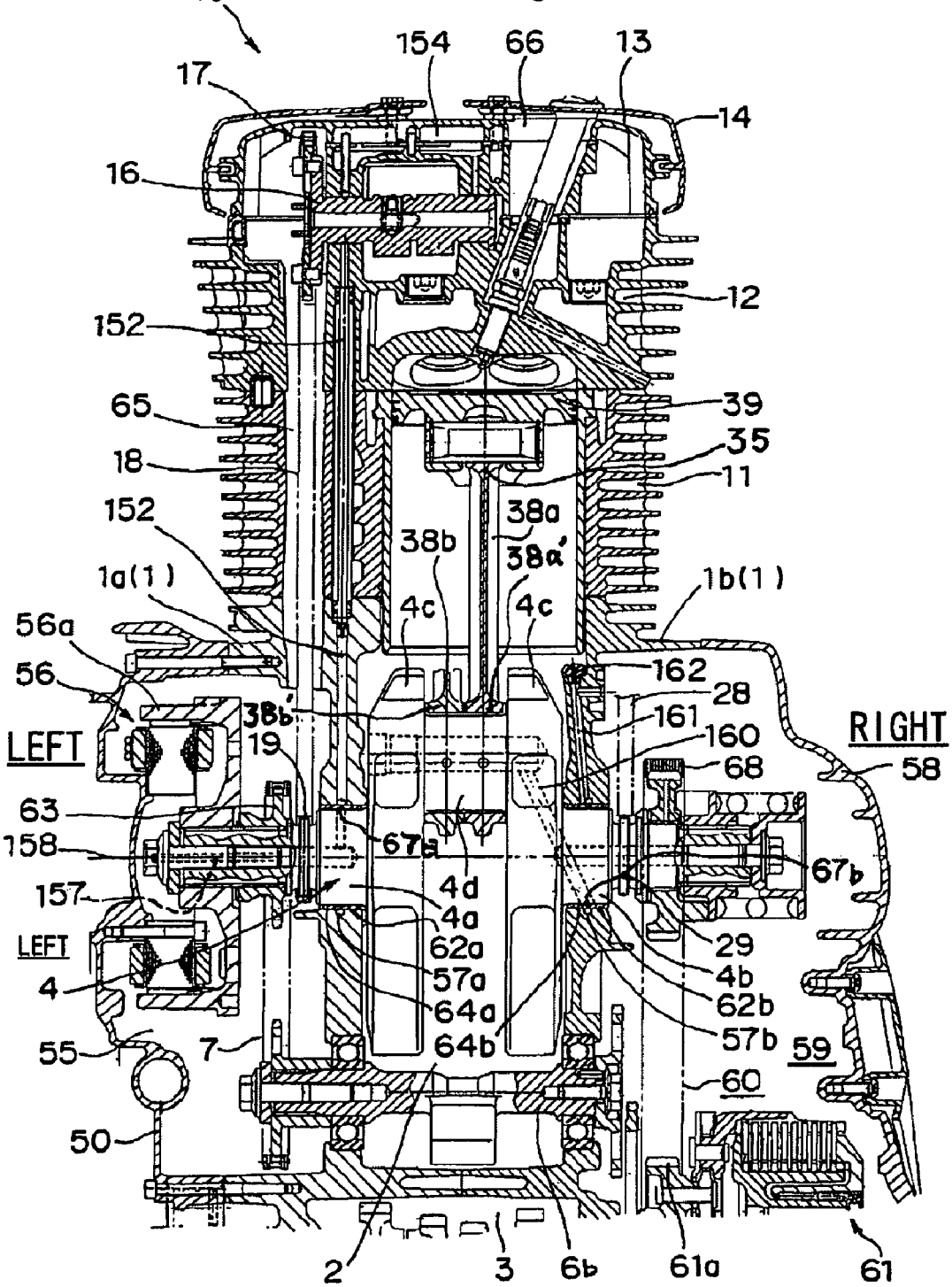
FIG. 2 is an enlarged sectional view taken along line II-II of FIG. 1.
Figure 3:
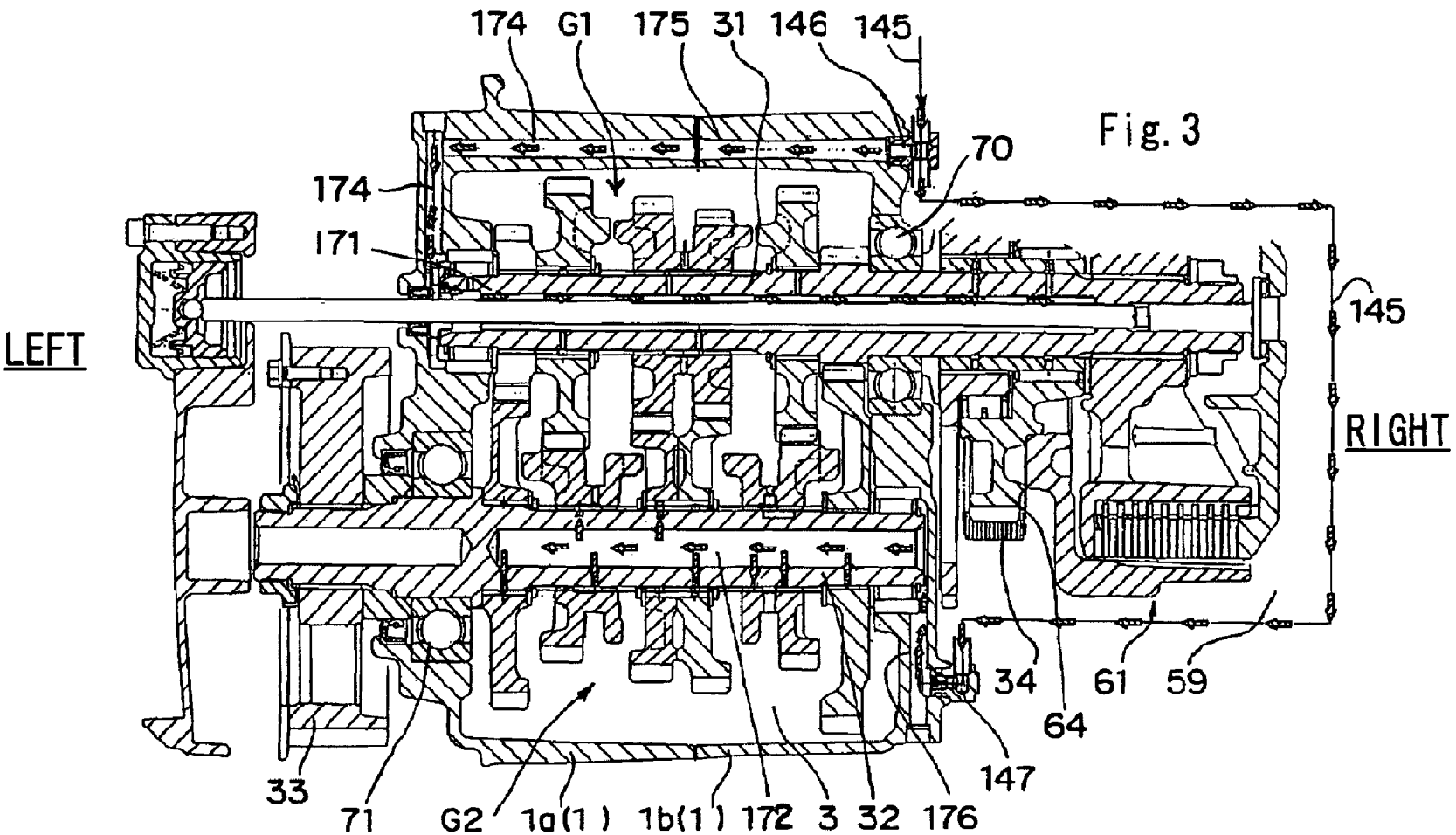
FIG. 3 is an enlarged sectional view taken along line III-III of FIG. 1.
Figure 4:
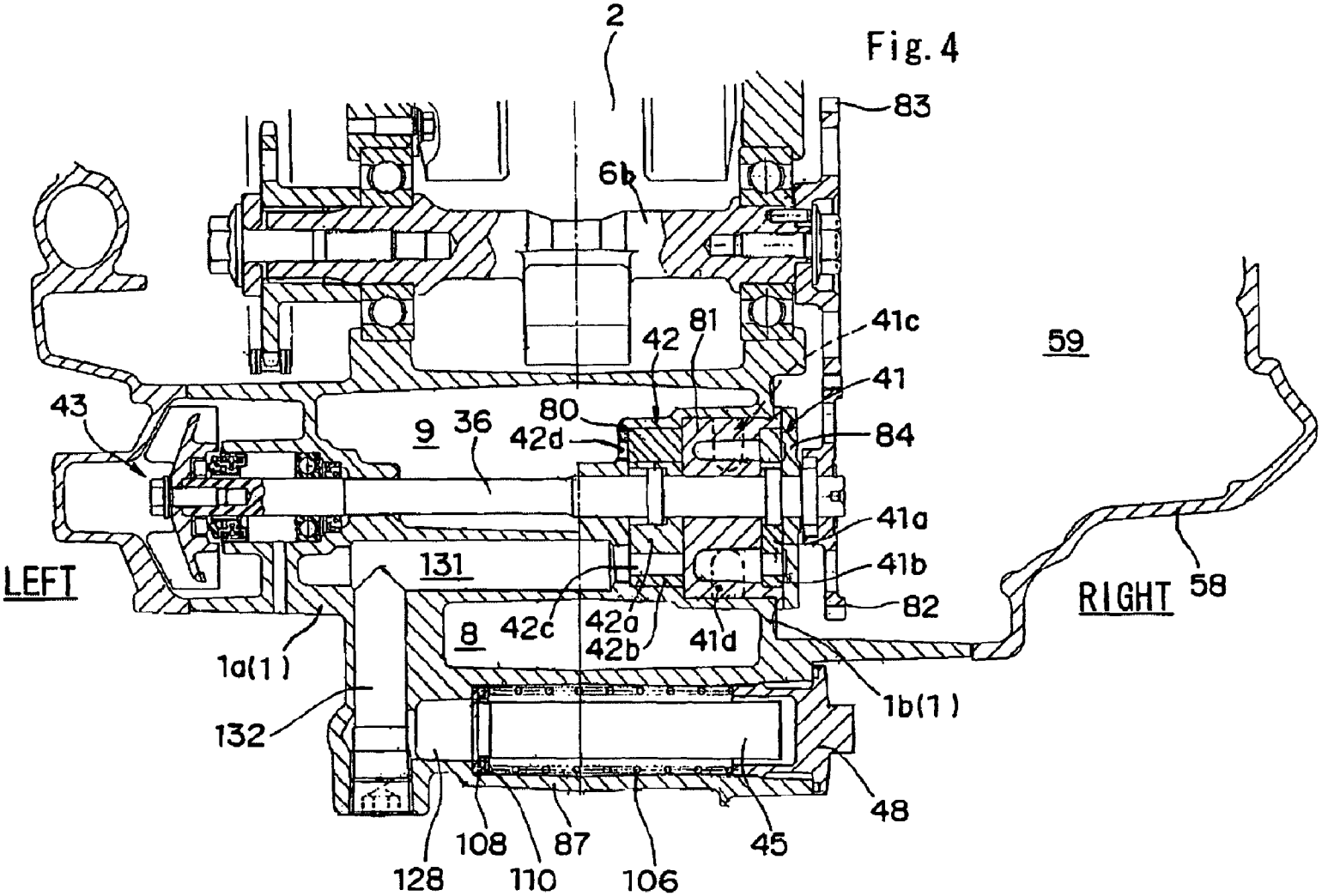
FIG. 4 is an enlarged sectional view taken along line IV-IV of FIG. 1.
Figure 5:
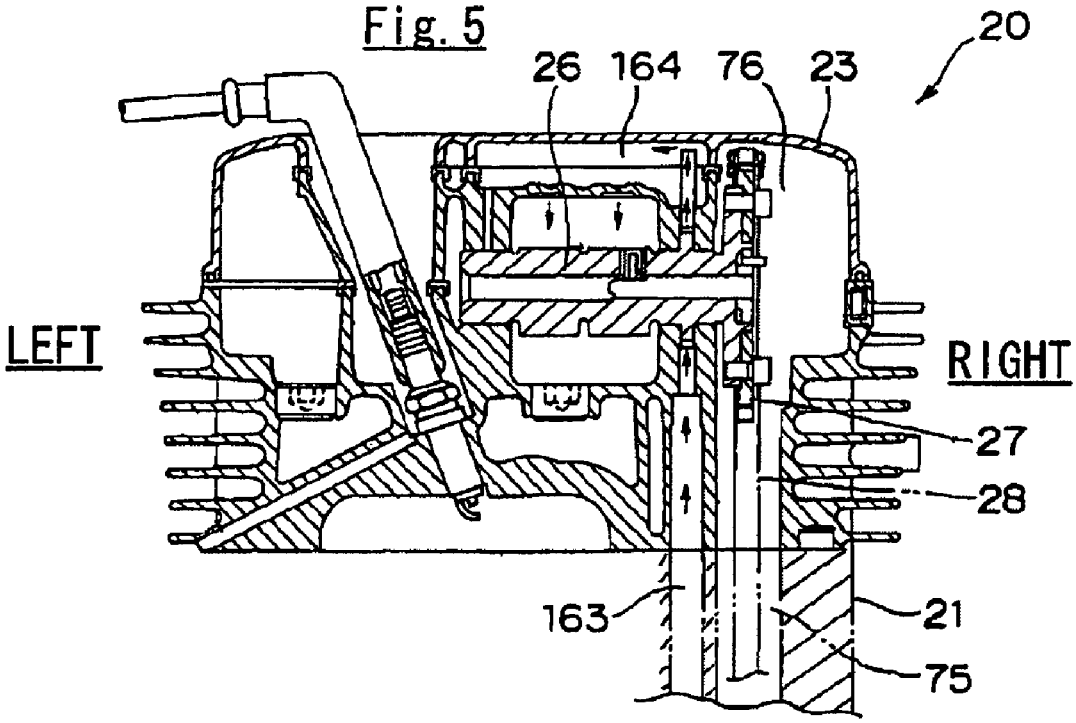
FIG. 5 is an enlarged sectional view taken along line V-V of FIG. 1.

FIG. 1 is a left side schematic view of the engine, FIG. 2 is an enlarged sectional view taken along line II-II of FIG. 1, FIG. 3 is an enlarged sectional view taken along line III-III of FIG. 1, FIG. 4 is an enlarged sectional view taken along line IV-IV of FIG. 1, and FIG. 5 is an enlarged sectional view taken along line V-V of FIG. 1. In FIG. 1, a front cylinder 10 in a forward inclining state and a rear cylinder 20 in a rearward inclining state are arranged in a V shape on an upper surface of a front half portion of a crank case 1. The cylinders 10 and 20 are respectively formed by cylinder bodies 11 and 21, cylinder heads 12 and 22 and cylinder head covers (rocker arm covers) 13 and 23 arranged from a bottom to an upper side, and coupled with the crank case 1. The cylinder head covers 13 and 23 are further covered by design covers 14 and 24.

The front half portion in the crank case 1 is a crank chamber 2. In the crank chamber 2, a crankshaft 4 extending in the left and right direction is arranged and a pair of front and rear primary balancer shafts 6*a* and 6*b* are arranged in substantially parallel to the crankshaft 4. The crankshaft 4 is to be rotated in an arrow R direction in the embodiment. The front and rear balancer shafts 6*a* and 6*b* are coupled to the crankshaft 4 via a chain drive mechanism 7 and rotated in an opposite direction to the crankshaft 4.

A rear half portion in the crank case 1 is a power transmission chamber 3. In the power transmission chamber 3, a transmission input shaft 31 and a transmission output shaft 32 are arranged in substantially parallel to the crankshaft 4 and a shift fork shaft and a change drum shaft (both not shown) and the like are arranged. An output pulley (or a sprocket) 33 having teeth is provided in a left end of the transmission output shaft 32. The output pulley 33 is interlocked with a pulley (or a sprocket) having teeth of a rear wheel via a secondary drive belt (or a drive chain) having teeth (not shown) so as to drive the rear wheel. It should be noted that although not shown, as another mechanism for driving the rear wheel, it is possible to provide a bevel gear instead of the output pulley 33 and provide a drive shaft instead of the secondary drive belt (or the drive chain) so as to provide a mechanism for driving the rear wheel by a shaft drive method.

A pump shaft 36 is arranged in substantially parallel to the crankshaft 4 at a lower position of the crankshaft 4 and the transmission input shaft 31 in a lower part of a border between the crank chamber 2 and the power transmission chamber 3. As shown in FIG. 4, the pump shaft 36 is provided with a feed pump 41 and a scavenging pump 42 as first and second oil pumps for lubricating oil, and a water pump 43 for cooling water. The water pump 43 is arranged in a left end of the pump shaft 36, and the feed pump 41 and the scavenging pump 42 are arranged in a right end of the pump shaft 36.

As shown in FIG. 1, a first primary oil filter 44 connected to an oil intake side of the feed pump 41 and a second primary oil filter 45 connected to an oil intake side of the scavenging pump 42 are arranged in a bottom wall part of the crank case 1 at lower positions of the feed pump 41 serving as the first oil pump and the scavenging pump 42 serving as the second oil pump. Both the primary oil filters 44 and 45 are arranged so that the first primary oil filter 44 is positioned on a rear side of the second primary oil filter 45 and both are aligned in a fore-aft direction in the vicinity of each other. A secondary oil filter 46 connected to an oil discharge side of the feed pump 41 is detachably attached in a lower end of a front end surface of the crank case 1.

Cam shafts 16 and 26 for driving intake and exhaust valves are respectively arranged in substantially parallel to the crankshaft 4 in upper ends of the cylinder heads 12 and 22 of the front and rear cylinders 10 and 20. Cam sprockets 17 and 27 respectively provided in left and right ends of the cam shafts 16 and 26 are interlocked with cam driving sprockets 19 and 29 provided in left and right ends of the crankshaft 4 via cam chain 18 and 28 respectively. As described in detail later, the cam sprocket 17, the cam chain 18 and the cam driving sprocket 19 for the front cylinder are arranged in a left side part of the front cylinder 10, and the cam sprocket 27, the cam chain 28 and the cam driving sprocket 29 for the rear cylinder are arranged in a right side part of the rear cylinder 20.

A generator cover 50 is detachably attached to a left side wall of the crank case 1. An oil supply port 52 is formed at a position in the vicinity of a front side of the water pump 43 in a lower part of the generator cover 50. An oil cap 53 having a rod-shaped oil gauge 53*a* is detachably screwed to the oil supply port 52.

In FIG. 2, the crank case 1 has a structure dually divided in the crankshaft direction, that is, a structure dually divided in the left and right direction in the embodiment. A left crank case member 1*a* and a right crank case member 1*b* are combined with each other on a matching surface substantially orthogonal to the crankshaft 4. A generator chamber 55 covered by the above generator cover 50 is formed on the left side of the left crank case member 1*a*, and a generator 56 is housed in the generator chamber 55. A clutch cover 58 is detachably attached to the right side of the right crank case member 1*b*. A primary drive chain 60 and a multiplate friction clutch 61 and the like are housed in a clutch chamber 59 covered by the clutch cover 58.

Left and right journal portions 4*a* and 4*b* of the crankshaft 4 are rotatably supported on bearing holes 64*a* and 64*b* of the left and right crank case members 1*a* and 1*b* respectively via bearing metals journal bearings) 62*a* and 62*b*. A pair of crank arms 4*c* formed between the left and right journal portions 4*a* and 4*b* and a crank pin 4*d* for coupling both the crank arms 4*c* are housed in the crank chamber 2. Lower large ends 38*a*' and 38*b*' of connecting rods 38*a* and 38*b* for the front and rear cylinders are fitted to the crank pin 4*d*. The connecting rods 38*a* and 38*b* respectively extend in the corresponding front and rear cylinders 10 and 20 (FIG. 1) and are coupled to pistons 39 (a piston for the rear cylinder is not shown) corresponding to upper small ends 35.

The left end of the crankshaft 4 protrudes in the generator chamber 55. The above left protruding part is provided with a rotor 56*a* of the generator 56, a sprocket 63 for driving a balancer, and the cam driving sprocket 19 for the front cylinder. The cam chain 18 is wound around the cam driving sprocket 19 for the front cylinder 10. The cam chain 18 passes through a cam chain tunnel 65 for the front cylinder 10 to a rocker arm chamber 66 of the front cylinder 10, and is wound around the sprocket 17 of the cam shaft 16 for the front cylinder as mentioned above. The cam chain tunnel 65 is formed in the left side part of the front cylinder 10

The right end of the crankshaft 4 protrudes in the clutch chamber 59. The above right protruding part is provided with a primary sprocket 68 for primary driving, and the cam driving sprocket 29 for the rear cylinder. The primary sprocket 68 is power-transmissively coupled to an input gear 61*a* of the clutch 61 via the primary drive chain 60. As shown in FIG. 5, the cam chain 28 wound around the cam driving sprocket 29 for the rear cylinder 20. The cam chain 28 passes through a cam chain tunnel 75 for the rear cylinder to a rocker arm chamber 76 of the rear cylinder 20, and is wound around the sprocket 27 of the cam shaft 26 for the rear cylinder as mentioned above. The cam chain tunnel 75 is formed in a right side wall part of the rear cylinder 20

In FIG. 3, a right end of the transmission input shaft 31 arranged in the power transmission chamber 3 is rotatably supported on the right crank case member 1*b* via a ball bearing 70, and also protrudes in the clutch chamber 59. The multi plate friction clutch 61 is installed to the above right protruding part. Meanwhile, a left end of the transmission output shaft 32 is rotatably supported on the left crank case member 1*a* via a ball bearing 71, and also protrudes in an outside of the power transmission chamber. The output pulley 33 for secondary driving is fixed to the above left protruding part. A transmission input gear group G1 and a transmission output gear group G2 meshing with each other are respectively installed in parts of the transmission input shaft 31 and the transmission output shaft 32 in the power transmission chamber 3. Oil seals are located adjacent to the ball bearings 70, 71. Otherwise, the ball bearings 70, 71 may be provided with oil seals.

(Pump Housing Portion 80 of Crank Case 1 and Oil Filter Retaining Portions 86 and 87)

Figure 6:
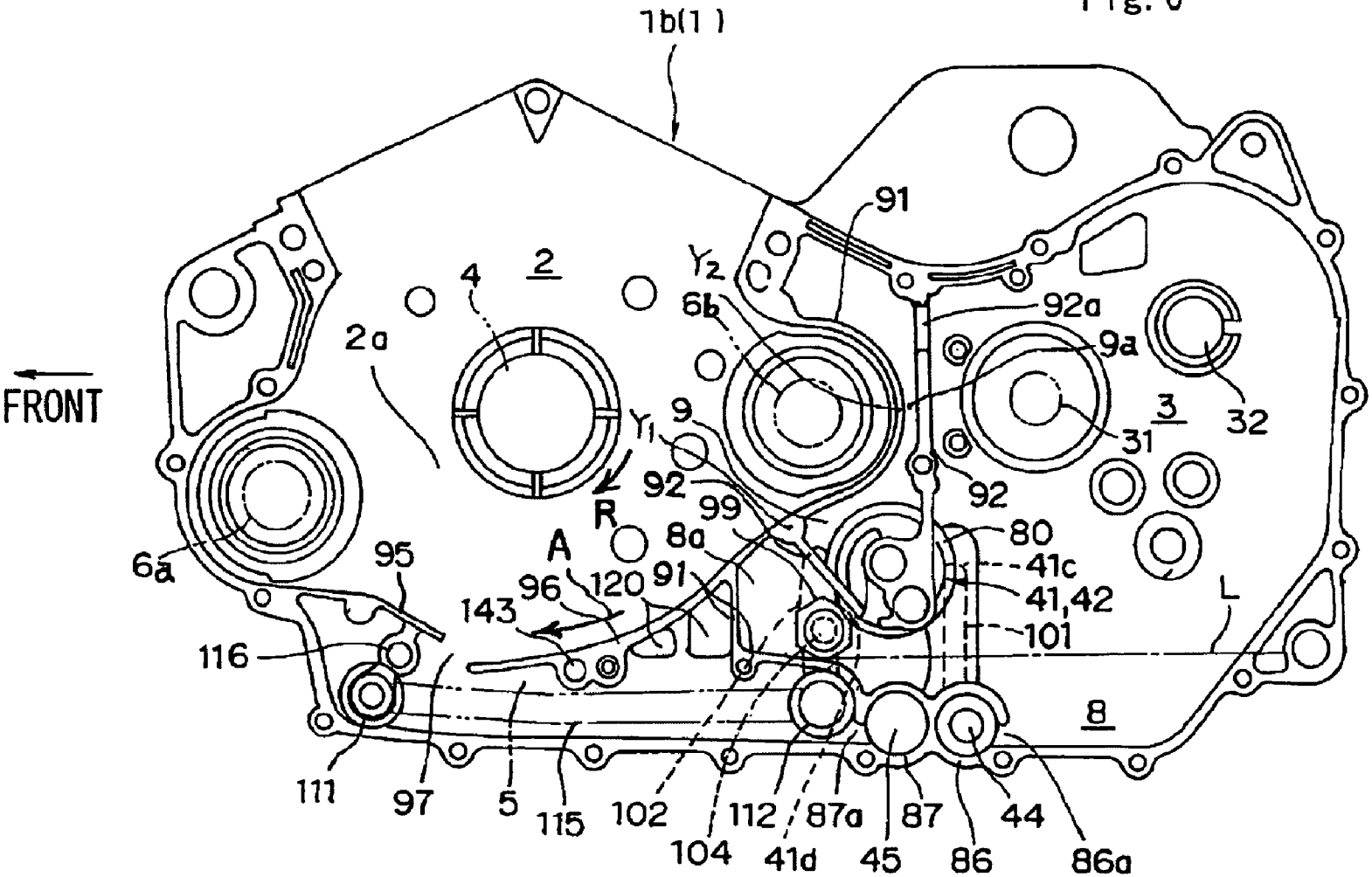
FIG. 6 is a left side view of a crank case member (a side view of an inside)
Figure 7:
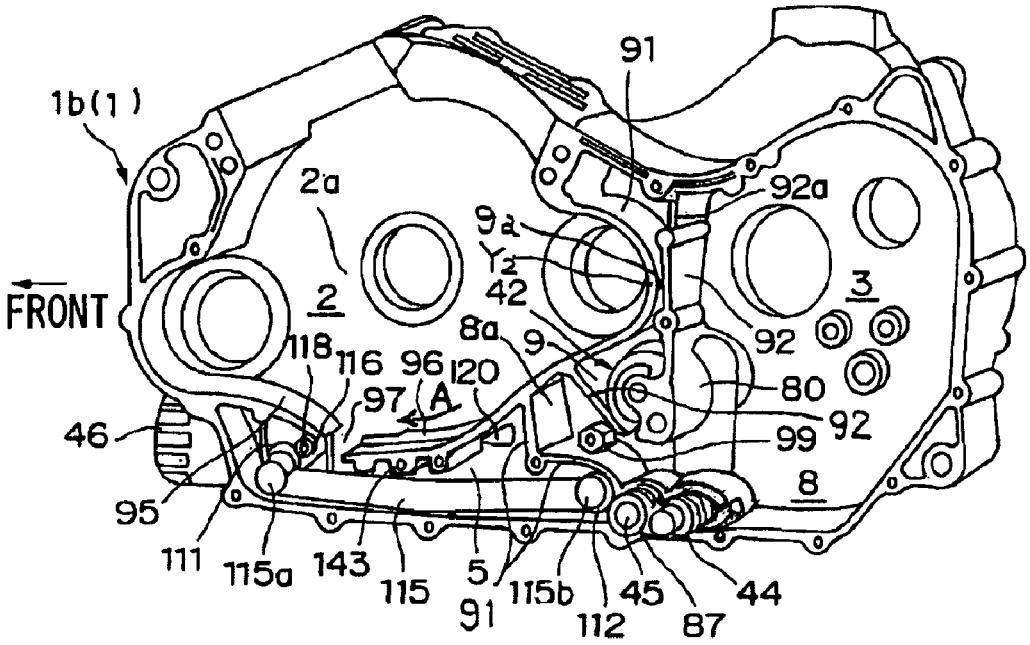
FIG. 7 is a perspective view in which an inside of a right crank case member is seen from a diagonally left rear side.
Figure 8:
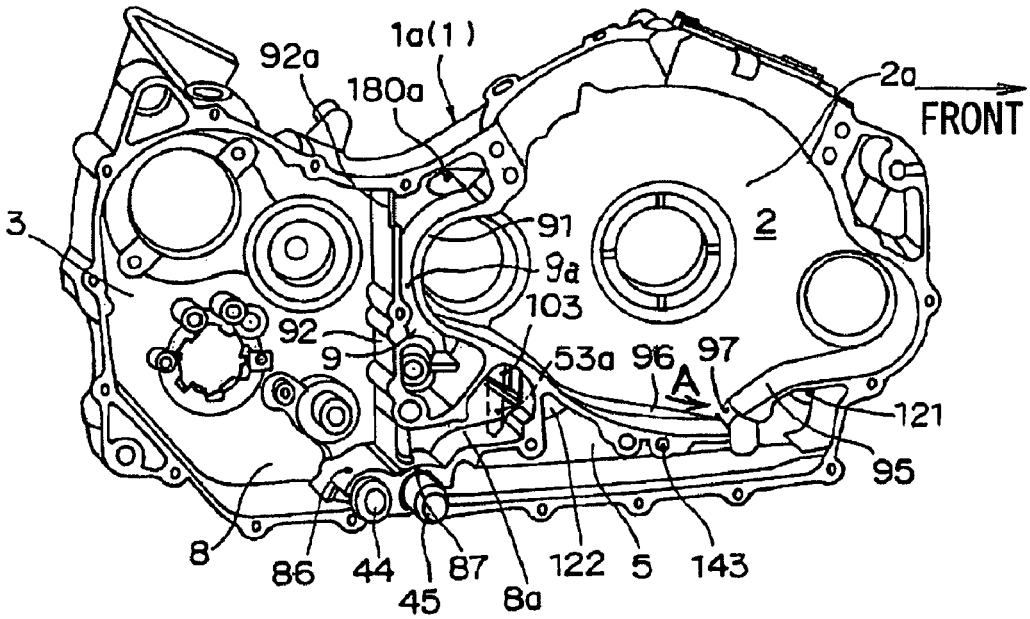
FIG. 8 is a perspective view in which an inside of a left crank case member is seen from a diagonally right rear side.
Figure 9:
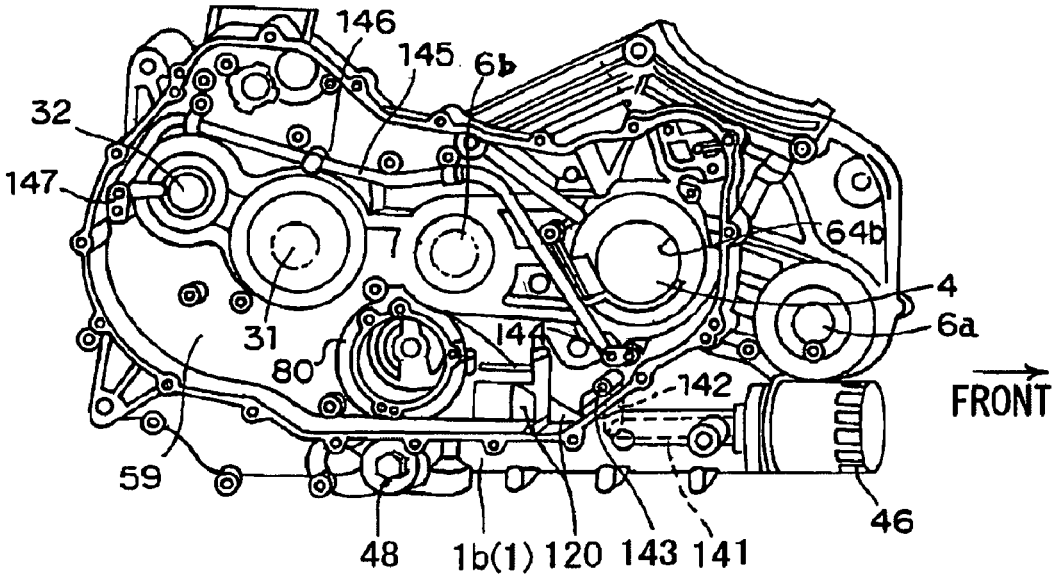
FIG. 9 is a perspective view in which an outside of the right crank case member is seen from a diagonally right front side.
Figure 10:
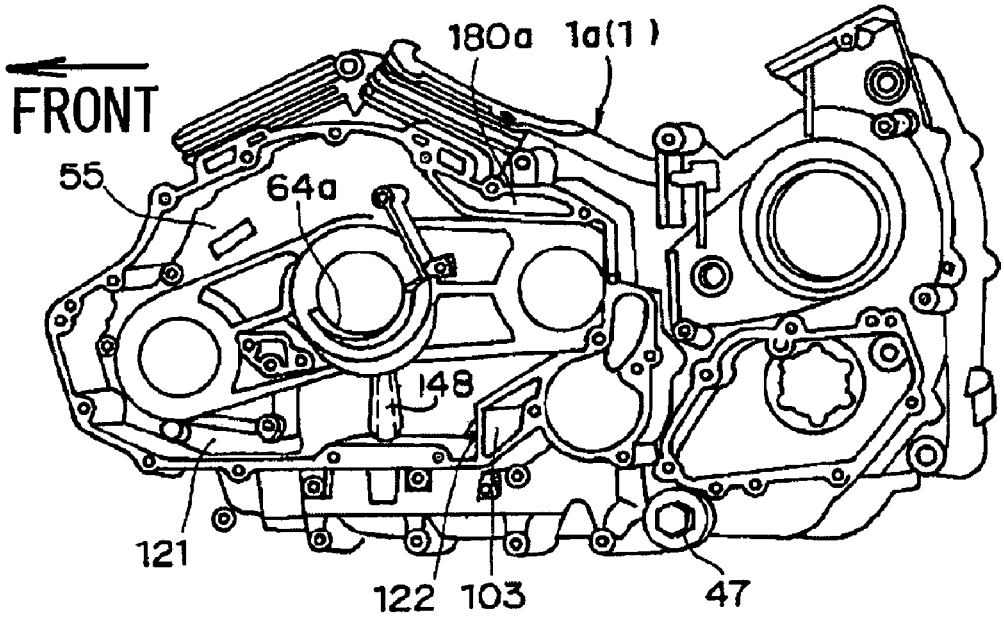
FIG. 10 is a perspective view in which an outside of the left crank case member is seen from a diagonally left rear side.

FIG. 6 is a left side view of the right crank case member 1*b* (a side view of an inside), FIG. 7 is a perspective view in which an inside of the right crank case member 1*b* is seen from a diagonally left rear side, FIG. 8 is a perspective view in which an inside of the left crank case member 1*a* is seen from a diagonally right rear side, FIG. 9 is a perspective view in which an outside of the right crank case member 1*b* is seen from a diagonally right front side, and FIG. 10 is a perspective view in which an outside of the left crank case member 1*a* is seen from a diagonally left rear side.

In FIG. 6, a common pump housing portion 80 for the feed pump 41 and the scavenging pump 42 is formed integrally with the right crank case member 1*b* at a lower position between the rear balancer shaft 6*b* and the transmission input shaft 31 in the fore-aft direction. At a lower position of the pump housing portion 80, a substantially cylindrical second oil filter retaining portion 87 for housing and retaining the second primary oil filter 45 connected to the oil intake side of the scavenging pump 42 is formed integrally with a bottom wall of the crank case 1. On the rear side of the second oil filter retaining portion 87, a substantially cylindrical first oil filter retaining portion 86 for retaining the first primary oil filter 44 connected to the oil intake side of the feed pump 41 is formed integrally with the bottom wall of the crank case 1. Both the oil filter retaining portions 86 and 87 are formed so as to extend in substantially parallel to the crankshaft 4 and aligned in the vicinity of each other in the fore-aft direction. A common member is used for both a part of a rear wall of the second oil filter retaining portion 87 and a part of a front wall of the first oil filter retaining portion 86.

(Crank Chamber 2 of Crank Case 1, Power Transmission Chamber 3 and Gas-Liquid Separation Chamber 9)

In FIG. 6, a first division wall 91 and a second division wall 92 are formed integrally with the crank case 1 between the crank chamber 2 and the power transmission chamber 3 in the fore-aft direction. By the above division walls 91 and 92, the crank chamber 2 and the power transmission chamber 3 are isolated from each other in the fore-aft direction and a gas-liquid separation chamber 9 isolated from the crank chamber 2 and the power transmission chamber 3 is formed in a front end of the power transmission chamber 3. The first division wall 91 extends downward from a rear end of a bore for the rear cylinder to a vicinity of a front upper end of the rear balancer shaft 6*b*, reaches to a lower end (front upward position of the pump housing portion 80) of the rear balancer shaft 6*b* while avoiding a rear side of the rear balancer shaft 6*b* in an arc shape, further extends front downward, curves downward and then rearward in a L shape, and is connected to a front upper end of the second oil filter retaining portion 87.

The second division wall 92 extends substantially vertically and straightly downward from an upper end wall of the crank case 1, passes through between the rear balancer shaft 6*b* and the transmission input shaft 31, reaches to a substantially rear lower end of the pump housing portion 80, extends front upward in a curve shape along an outer periphery of a lower part of the pump housing portion 80, and is connected to a position in the vicinity of the lower end of the rear balancer shaft 6*b* of the first division wall 91. An overflow type oil discharge port or halls 92*a* for achieving communication between an upper end of the gas-liquid separation chamber 9 and an upper end of the power transmission chamber 3 is formed in an upper end of the second division wall 92. That is, the above oil discharge port 92*a* is formed between a lower surface of the upper end wall of the crank case 1 and an upper end concave portion of the second division wall 92, and positioned higher than a shaft center of the crankshaft 4 and a shaft center of the transmission input shaft 31. Since the first division wall 91 expands rearward in an arc shape along an outer periphery of the rear balancer shaft 6*b*, a shape of the gas-liquid separation chamber 9 seen from the side is a "gourd shape" or a "hourglass shape" in which an intermediate part in an up and down direction is constricted. Thereby, a shape of the first division wall 91 from an intersection point Y1 between the first division wall 91 and the second division wall 92 to a point Y2 corresponding to a constricted part (the most constricted part) 9*a* on an upper side always shows an upward inclination toward a rear side, and becomes an arc shape coming close to the second division wall 92 toward the upper side. On the other hand, a shape of the first division wall 91 on the upper side of the point Y2 corresponding to the constricted part 9*a* always shows an upward inclination toward a front side until reaching height substantially corresponding to the oil discharge port 92*a*, and becomes an arc shape moving away from the second division wall 92 toward the upper side. The scavenging pump 42 and the feed pump 41 are positioned in a lower end of the gas-liquid separation chamber 9.

The lower end of the power transmission chamber 3 is an oil reserving portion 8 for reserving or gathering the lubricating oil for semi-dry sump lubrication. A front end of the oil reserving portion 8 passes through a section between both the oil filter retaining portions 86 and 87 and the gas-liquid separation chamber 9 in the up and down direction and extends to a front part of the pump housing portion 80. That is, an extension portion 8*a* spreading over a front position of the pump housing portion 80 is formed. The above extension portion 8*a* is utilized as a relief route of the oil discharged from a relief valve 99 described later. The oil is gathered in the oil reserving portion 8, and a level of the oil is maintained to about L for example during operation of the engine.

(Structure of Oil Passage and Oil Supply Port and the Like in Crank Case 1)

An oil passage 101 connected to the intake side of the feed pump 41 and an oil passage 102 connected to the discharge side of the feed pump 41 are formed in a wall of the right crank case member 1*b*. The oil passage 101 extends downward from a pump intake port 41*c* of the feed pump 41 formed in a rear end of the pump housing portion 80 to a right end outlet portion of the first oil filter retaining portion 86. The oil passage 102 extends downward from a pump discharge port 41*d* of the feed pump 41 formed in a front end of the pump housing portion 80. A relief valve attachment portion 104 opening in the extension portion 8*a* of the oil reserving portion 8 is formed in the middle of the oil passage 102 on the discharge side of the feed pump. The relief valve 99 is attached to the relief valve attachment portion 104.

In FIG. 8, an oil supply passage 103 passing through the left crank case member 1*a* in the left and right direction is formed on a left side surface of an upper end of the extension portion 8*a* of the oil reserving portion 8. As shown in FIG. 10, the oil supply passage 103 extends leftward in a rear lower end of the generator chamber 55 and communicates with the oil supply port 52 of the generator cover 50 described in FIG. 1. That is, by supplying the oil from the oil supply port 52, it is possible to directly supply the oil to the extension portion 8*a* of the oil reserving portion 8 in FIG. 8 via the oil supply passage 103 in FIG. 10. The oil gauge 53*a* provided in the oil cap 53 in FIG. 1 passes through the oil supply passage 103 in FIG. 10 and reaches to an inside of the extension portion 8*a* of the oil reserving portion 8 as shown in FIG. 8. Thereby, it is possible to check the oil level in the oil reserving portion 8.

(Structure of Oil Retrieving Portion 5)

In FIG. 6, a lower end in the crank chamber 2 is partitioned from a crankshaft housing portion by a front partition wall 95 and a rear partition wall 96 so as to be formed as an oil retrieving portion 5. The oil retrieving portion 5 ranges from a front end wall of the crank case 1 to a front end of the second oil filter retaining portion 87. The front partition wall 95 extends rearward from a position in the vicinity of a lower end of the front balancer shaft 6*a* and terminates in the vicinity of a position in the fore-aft direction substantially corresponding to a front end of the crankshaft 4. The rear partition wall 96 extends forward in a curve shape substantially along a rotation trajectory of a crank arm part of the crankshaft 4 from a position of a front upper end of the extension portion 8*a* of the oil reserving portion 8, and then reaches to a rear lower position while leaving a fixed clearance relative to a rear end of the front partition wall 95. That is, communication hole (oil retrieving port) 97 opening front downward is formed between the rear end of the front partition wall 95 and a front end of the rear partition wall 96. In other words, the communication hole 97 opens so as to face oil flow moving forward over the rear partition wall 96 by rotation of the crankshaft 4 in an arrow R direction.

Tubular oil pipe connecting portions 11 and 112 respectively opening in a front end and a rear end of the oil retrieving portion 5 are formed in the right crank case member 1*b*. The rear oil pipe connecting portion 112 is arranged in the vicinity of a front side of the second oil filter retaining portion 87 and communicates with a lower end of the oil passage 102 on the discharge side of the feed pump. The front oil pipe connecting portion 111 communicates with a passage before filtering of the secondary oil filter 46 shown in FIG. 7 via an oil passage (not shown) passing through the wall of the right crank case member 1*b*. A boss portion 116 having a female screw hole for fixing an oil pipe is formed at a rear upper position of the front oil pipe connecting portion 111.

An oil pipe 115 for connecting the front and rear oil pipe connecting portions 111 and 112 so as to distribute the oil is arranged in the oil retrieving portion 5. The oil pipe 115 extends in the fore-aft direction in the oil retrieving portion 5. Connecting tube portions 115*a* and 115*b* substantially orthogonal to a longitudinal direction of the oil pipe 115 are formed in front and rear ends of the oil pipe 115. The rear connecting tube portion 115*b* is fitted and connected to the rear oil pipe connecting portion 112. The front connecting tube portion 115*a* is fitted and connected to the front oil pipe connecting portion 111 and fixed to the boss portion 116 by a bolt 118.

An oil hole 120 passing through the right crank case member 1*b* in the left and right direction is formed on a right side surface of a rear upper end of the oil retrieving portion 5, that is, on a right side surface at a position in the vicinity of a front side of the extension portion 8*a* of the oil reserving portion 8. The oil hole 120 passes through the right crank case member 1*b* and communicates with a front lower end of the clutch chamber 59 as shown in FIG. 9. That is, the oil returning to the clutch chamber 59 is retrieved to the oil retrieving portion 5 through the oil hole 120

In FIG. 8, oil holes 121 and 122 passing through the left crank case member 1*a* are formed on left side surfaces of a front upper end and the rear upper end of the oil retrieving portion 5. The oil holes 121 and 122 respectively pass through the left crank case member 1*a* and communicate with a front lower end and the rear lower end of the generator chamber 55 as shown in FIG. 10 (and FIG. 13). That is, the oil returning to the generator chamber 55 is retrieved to the oil retrieving portion 5 through the oil holes 121 and 122.

(Structure of Oil Pumps 41 and 42)

In FIG. 4, the common pump housing portion 80 for the oil pumps is formed integrally with the right crank case member 1*b*. Internal and external rotors 42*a* and 42*b* for the scavenging pump 42, a common pump body 81 and internal and external rotors 41*a* and 41*b* for the feed pump 41 are installed from the left side to the right side in the common pump housing portion 80. A right end of the pump housing portion 80 is closed by a pump cover 84. That is, the scavenging pump 42 having a large capacity is arranged on the left side and the feed pump 41 having a smaller capacity than the scavenging pump 42 is arranged on the right side relative to the common pump body 81. Both the oil pumps 41 and 42 are a trochoid type pump in which pairs of the internal and external rotors 41*a*,41*b* and 42*a*,42*b* are rotatably housed in a meshed state each other. The internal rotors 41*a* and 42*a* are coupled to the common pump shaft 36. The right end of the pump shaft 36 protrudes from the pump cover 84 in the clutch chamber 59 on the right side. A pump input gear 82 fixed to the right protruding part is meshed with a gear 83 fixed to the rear balancer shaft 6*b*, and rotated in the opposite direction to the rear balancer shaft 6*b* while the power is transmitted from the rear balancer shaft 6*b*.

The scavenging pump 42 is an oil pump (the second oil pump) for returning the oil already used for lubricating to the oil reserving portion 8 via the gas-liquid separation chamber 9 and positioned in the lower end of the gas-liquid separation chamber 9 as mentioned above. A pump intake port 42*c* for the scavenging pump formed in a left end wall of the pump housing portion 80 communicates with an oil passage 131 extending leftward in the crank case 1. A left end of the oil passage 131 communicates with an oil passage 132 extending downward in the left crank case member 1*a*. A lower end of the oil passage 132 communicates with an oil filter outlet portion 128 in a left end of the second oil filter retaining portion 87. A pump discharge port 42*d* for the scavenging pump formed in the left end wall of the pump housing portion 80 opens in the lower end of the gas-liquid separation chamber 9. Therefore, the pump discharge port 42*d* also serves as an oil inlet of the gas-liquid separation chamber 9. As shown in FIG. 6, an opening area of the oil discharge port 92*a* formed in the upper end of the gas-liquid separation chamber 9 is formed so as to be larger than an opening area of the above oil inlet (the pump discharge port) 42*d* (FIG. 4).

The feed pump 41 is an oil pump (the first oil pump) for pressure-feeding the oil in the oil reserving portion 8 to a plurality of lubricant points of the engine. As shown in FIG. 4, the pump intake port 41*c* and the pump discharge port 41*d* are formed in the pump body 81. As described in FIG. 6, the pump intake port 41*c* of the feed pump 41 communicates with the first primary oil filter 44 via the vertical oil passage 101 formed in the wall of the right crank case member 1*b*. The pump discharge port 41*d* communicates with the rear oil pipe connecting portion 112 of the oil retrieving portion 5 via the oil passage 102.

The relief valve 99 positioned in the extension portion 8*a* of the oil reserving portion 8 is attached to the relief valve attachment portion 104 formed in the middle of the oil passage 102 so as to directly return the extra oil released from the relief valve 99 to the oil reserving portion 8.

(Attachment Structure of Primary Oil Filters 44 and 45)

Figure 11:
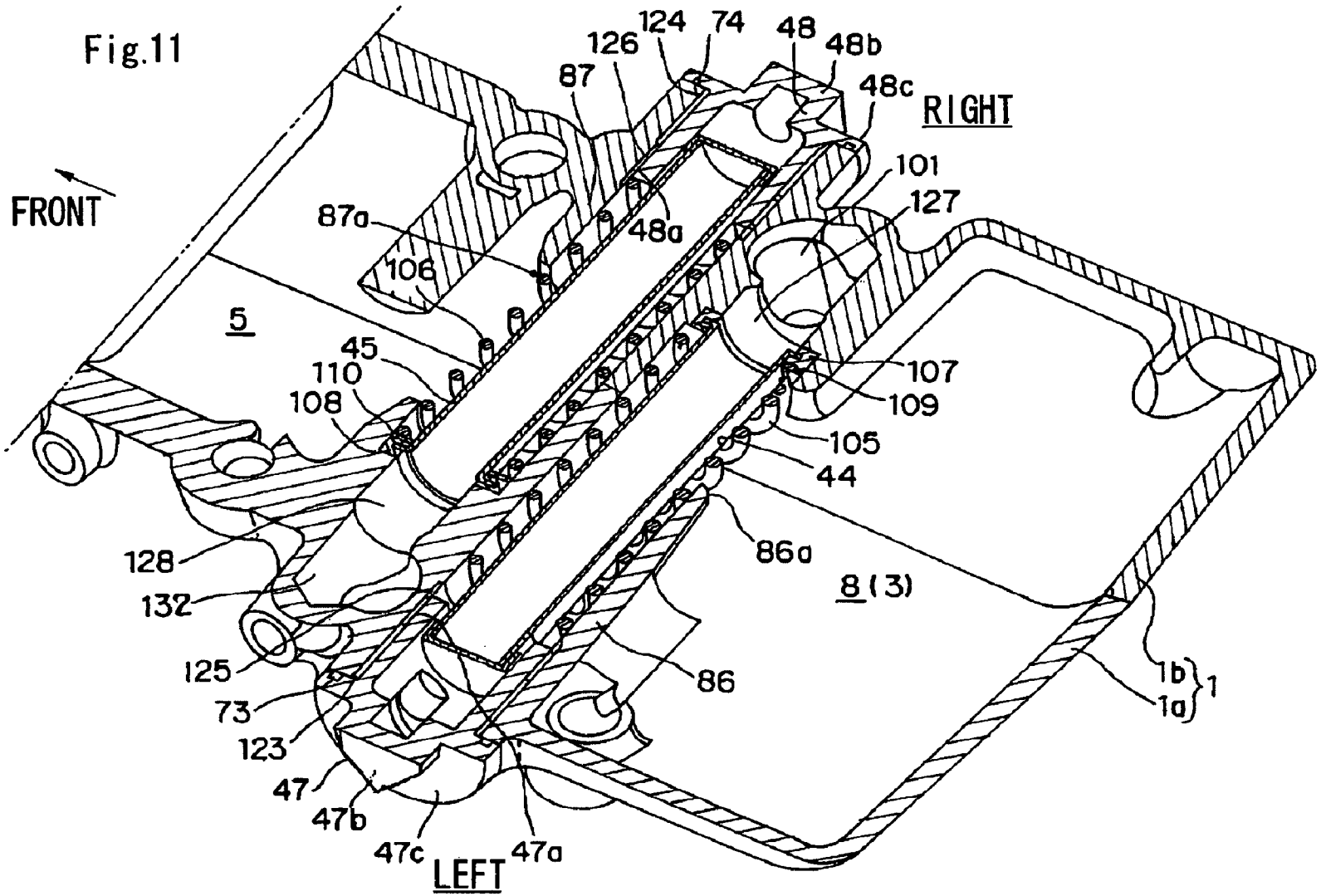
FIG. 11 is an enlarged sectional perspective view taken along line XI-XI of FIG. 1.

FIG. 11 is an enlarged sectional view taken along line XI-XI of FIG. 1 and shows a structure of both the primary oil filters 44 and 45 and an attachment structure thereof in detail. Both the oil filter retaining portions 86 and 87 formed in a substantially cylindrical shape are formed so as to range from a substantially right end of the right crank case member 1*b* to a substantially left end of the left crank case member 1*a*. In the first oil filter retaining portion 86 for the feed pump positioned on the rear side, an oil filter attachment port 123 opens in a left end surface of the left crank case member 1*a*, a female screw portion 125 is formed on an inner peripheral surface in the vicinity of the oil filter attachment port 123, an oil filter outlet portion 127 is formed in a right end of the right crank case member 1*b*, and a slit-shaped oil intake port 86*a* opening toward the oil reserving portion 8 on the rear side is formed in a center part in the left and right direction including the matching surface between both the crank case members 1*a* and 1*b*. The oil filter outlet portion 127 formed in a right end of the first oil filter retaining portion 86 communicates with a lower end of the oil passage 101 on the intake side of the feed pump formed in the right crank case member 1*b*.

In the substantially cylindrical first primary oil filter 44, a right end thereof opens as an oil outlet, a left end thereof is closed, an outer peripheral cylindrical surface thereof is a filtering surface, and a circular grommet 107 made of an elastic material is installed in a right end opening portion thereof. An oil filter cap 47 for closing the oil filter attachment port 123 of the first oil filter retaining portion 86 is formed in a cylindrical shape with a bottom having an outward flange portion 47*c*. A male screw portion 47*a* is formed on an outer peripheral surface of a right end thereof and a hexagonal engagement portion 47*b* for engaging tools is formed in a left end wall thereof. Further, an O-ring 73 is installed in a circular groove formed on a right end surface of the flange portion 47*c*.

The first primary oil filter 44 is inserted into the first oil filter retaining portion 86 via the oil filter attachment port 123, and a circular spring receiver 109 and a coil spring 105 are fitted onto an outer periphery thereof in order. The oil filter cap 47 is inserted from the left end oil filter attachment port 123 into the first oil filter retaining portion 86 and screwed into the female screw portion 125. Thereby, the coil spring 105 is compressed by the right end of the oil filter cap 47 and the grommet 107 is pressed to a circular step surface of the right end of the first oil filter retaining portion 86 via the spring receiver 109. That is, a peripheral edge of a right end opening portion of the first primary oil filter 44 is sealed by the grommet 107, the primary oil filter 44 is fixed by the oil filter cap 47 and further a circumference of the oil filter attachment port 123 is sealed by the O-ring 73.

In the second oil filter retaining portion 87 for the scavenging pump positioned on the front side of the first oil filter retaining portion 86, an oil filter attachment port 124 opens on a right end surface of the right crank case member 1*b*, a female screw portion 126 is formed on an inner peripheral surface thereof in the vicinity of the oil filter attachment port 124, an oil filter outlet portion 128 is formed in a left end of the left crank case member 1*a*, and a slit-shaped oil intake port 87*a* opening toward the oil retrieving portion 5 on the front side is formed in the center part in the left and right direction including the matching surface between both the crank case members 1*a* and 1*b*.

The substantially cylindrical second primary oil filter 45 and an oil filter cap 48 formed in a cylindrical shape with a bottom have the same structure as the first primary oil filter 44 and the oil filter cap 47 and are installed in the second oil filter retaining portion 87 with the reversed left and right sides. That is, in the substantially cylindrical second primary oil filter 45, a left end thereof opens as an oil outlet, a right end thereof is closed, an outer peripheral cylindrical surface thereof is a filtering surface, and a circular grommet 108 made of an elastic material is installed in a left end opening portion thereof. The oil filter cap 48 for closing the oil filter attachment port 124 of the second oil filter retaining portion 87 is formed in a cylindrical shape with a bottom having an outward flange portion 48*c*. A male screw portion 48*a* is formed on an outer peripheral surface of a left end thereof and a hexagonal engagement portion 48*b* for engaging tools is formed in a right end wall thereof. Further, an O-ring 74 is installed in a circular groove formed on a left end surface of the outward flange portion 48*c*.

An attachment structure of the second primary oil filter 45 is the same as the first primary oil filter 44. That is, the second primary oil filter 45 is inserted into the second oil filter retaining portion 87 from the right end oil filter attachment port 124, and a circular spring receiver 110 and a coil spring 106 are fitted onto an outer periphery thereof in order. The oil filter cap 48 is inserted from the right end oil filter attachment port 124 and screwed into the female screw portion 126. Thereby, the coil spring 106 is compressed by the left end of the oil filter cap 48 and the grommet 108 is pressed to a circular step surface of the left end of the second oil filter retaining portion 87 via the spring receiver 110. That is, a peripheral edge of a left end opening portion of the second primary oil filter 45 is sealed by the grommet 108, the primary oil filter 45 is fixed by the oil filter cap 48 and further a circumference of the oil filter attachment port 124 is sealed by the o ring 74.

(Structure of Oil Supplying Route After Secondary Oil Filter 46 and Lubricant Point)

In FIG. 9, an oil outlet after filtering the oil of the secondary oil filter 46 communicates with a main oil passage (a main gallery) 141 formed in the wall of the right crank case member 1*b*. The main oil passage 141 extends rearward and a roar end thereof communicates with a vertical main oil passage 142 extending upward. The vertical main oil passage 142 reaches to the bearing hole 64*b* of the right crank case member 1*b*.

An oil passage 143 extending leftward in substantially parallel to the crankshaft 4 and a transmission oil extracting portion 144 communicate with a middle of the vertical main oil passage 142. A transmission oil pipe 145 is connected to the transmission oil extracting portion 144. The oil pipe 145 extends rear upward in the clutch chamber 59, also extends rearward in the vicinity of an upper wall of the clutch chamber 59 and is connected to an oil inlet portion 146 of the transmission input shaft 31 and an oil inlet portion 147 of the transmission output shaft 32 respectively. The oil passage 143 extending leftward on the lower side of the crankshaft 4 passes through a lower surface of the rear partition wall 96 in the right crank case member 1*b* of the crank chamber 2 as shown in FIG. 7, reaches to a lower surface of the rear partition wall 96 in the left crank case member 1*a* shown in FIG. 8, and communicates with a vertical oil passage 148 formed in a wall of the left crank case member 1*a* as shown in FIG. 10. The above vertical oil passage 148 reaches to the bearing hole 64*a* of the left crank case member 1*a*.

(Lubricant Points Around Crankshaft 4)

In FIG. 2, circular oil passages 57*a* and 57*b* are respectively formed on inner peripheral surfaces of the bearing holes 64*a* and 64*b* of the left and right crank case members 1*a* and 1*b* for supporting the left and right journal portions 4*a* and 4*b* of the crankshaft 4. The circular oil passages 57*a* and 57*b* respectively communicate with the vertical oil passages 142 and 148 (in FIGS. 9 and 10) formed in the crank case members 1*a* and 1*b*.

Major lubricant points to which the oil is supplied from the left circular oil passage 57*a* are a fitting part between the left bearing metal 62*a* and the left journal portion 4*a*, a stator portion of the generator 56, the cam shaft 16 of the front cylinder and the like. The oil is supplied to the fitting part between the left bearing metal 62*a* and the left journal portion 4*a* via an oil hole 67*a* in a radial direction formed in the left bearing metal 62*a*. The oil is once supplied to an oil chamber 154 arranged on the upper side of the cam shaft 16 for the front cylinder via an oil passage 152 formed in the left side part of the front cylinder 10 and then the oil is dropped down from the oil chamber 154 to the cam shaft 16. The oil is supplied to a nozzle portion 158 via an oil passage 157 extending leftward in the crankshaft 4 and then the oil is sprayed from the nozzle portion 158 to the stator portion of the generator 56.

Major lubricant points to which the oil is supplied from the right circular oil passage 57*b* are a fitting part between the right bearing metal 62*b* and the right journal portion 4*b*, a fitting part between the crank pin 4*d* and the large ends of the connecting rods 38*a* and 38*b*, the primary sprocket 68, an inside of the piston 39 for the front cylinder, the cam shaft 26 for the rear cylinder shown in FIG. 5 and the like. Back to FIG. 2, the oil is supplied to the fitting part between the right bearing metal 62*b* and the right journal portion 4*b* via an oil hole 67*b* in the radial direction formed in the right bearing metal 62*b*. The oil is supplied to the fitting part between the crank pin 4*d* and the large ends of the connecting rods 38*a* and 38*b* via an oil passage 160 formed in the crankshaft 4. The oil is supplied to an oil jet 162 via an oil passage 161 in the right crank case member 1*b* and then the oil is sprayed from the oil jet 162 to the inside of the piston 39 of the front cylinder 10. As shown in FIG. 5, the oil is once supplied to an oil chamber 164 arranged on the upper side of the cam shaft 26 for the rear cylinder via an oil passage 163 formed in the right side part of the rear cylinder 20 and then the oil is dropped down from the oil chamber 164 to the cam shaft 26 of the rear cylinder 20.

(Lubricant Points of Power Transmission Chamber 3)

In FIG. 3, oil passages 171 and 172 extending in a shaft direction are respectively formed in the transmission input shaft 31 and the transmission output shaft 32. The oil passages 171 and 172 respectively communicate with fitting parts of gears of the transmission gear groups G1 and G2 via diverging passages extending in the radial direction. A left end of the oil passage 171 of the transmission input shaft 31 communicates with an oil passage 174 of the left crank case member 1*a*. The oil passage 174 curves rightward in a L shape and communicates with an oil passage 175 of the right crank case member 1*b* via the matching surface between both the crank case members 1*a* and 1*b*. Aright end of the oil passage 175 reaches to the oil inlet portion 146 for the transmission input shaft, and the oil is supplied from the oil pipe 145. A right end of the oil passage 172 for the transmission output shaft 32 reaches to the oil inlet portion 147 for the transmission output shaft via an oil passage 176 of the right crank case member 1*b*, and the oil is supplied from the oil pipe 145.

(Returning Route of Lubricating Oil of Front and Rear Cylinders 10 and 20)

Figure 12:
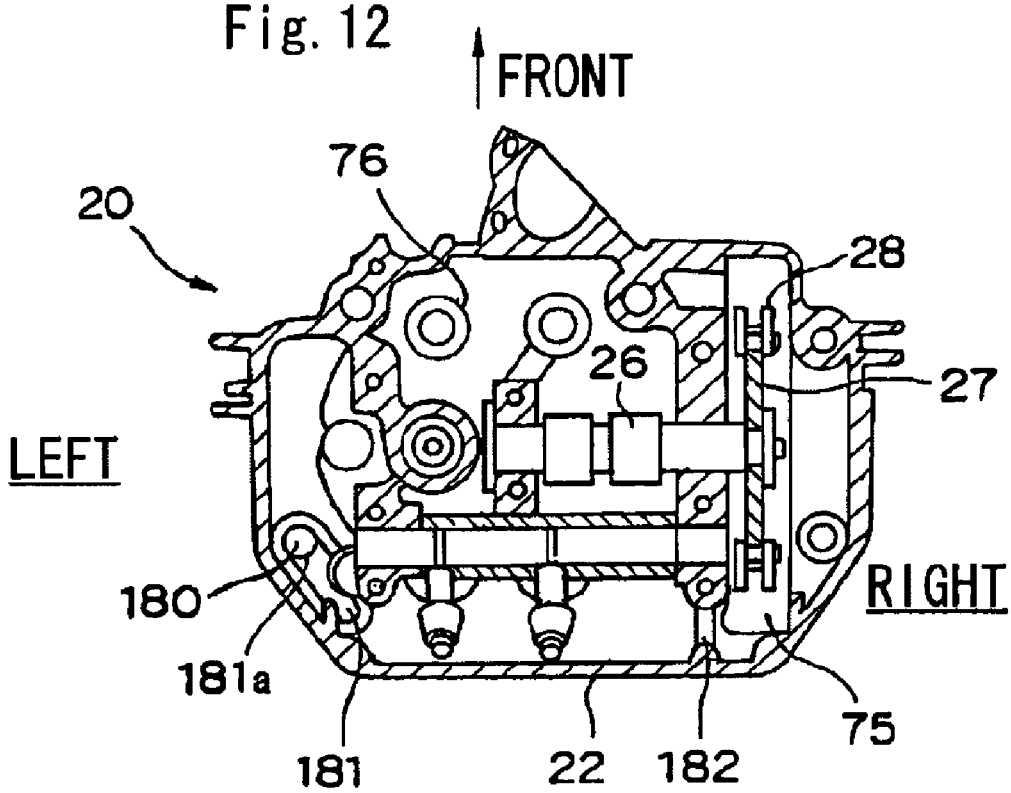
FIG. 12 is an enlarged sectional view taken along line XII-XII of FIG. 1.
Figure 13:
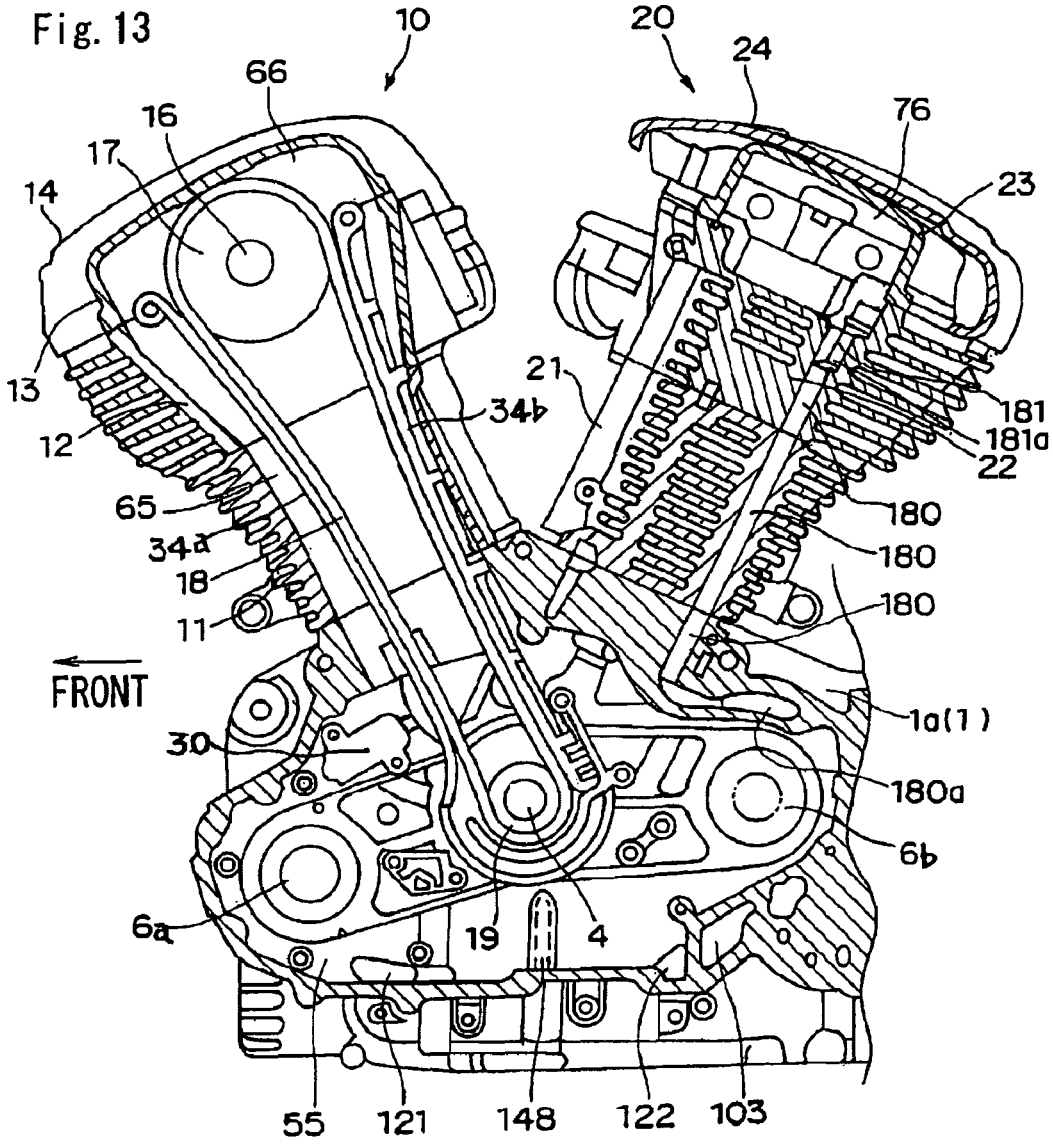
FIG. 13 is an enlarged vertically sectional side view of a left end of the engine in FIG. 1.

FIG. 12 is a sectional view taken along line XII-XII of FIG. 1, and FIG. 13 is a left side view in which a loft side part of the engine is cut by a vertical surface orthogonal to the crankshaft 4. In FIG. 13, the cam chain tunnel 65 formed on the left side of the front cylinder 10 is utilized as an oil returning route from the rocker arm chamber 66 of the front cylinder 10. The oil is returned to the generator chamber 55 via the cam chain tunnel 65. A chain guide 34*a* for guiding a front side part of the cam chain 18 and a chain slipper (a chain guide) 34*b* for guiding a rear side part of the cam chain 18 are arranged in the cam chain tunnel 65. A hydraulic cam chain tensioner 30 for tensioning the cam chain 18 is arranged in the vicinity of the cam chain tunnel 65 in an upper end in the generator chamber 55. The oil supplied to the above hydraulic cam chain tensioner 30 is also returned directly or from the cam chain tunnel 65 to the generator chamber 55.

Meanwhile, in FIG. 12, the cam chain tunnel 75 formed on the right side of the rear cylinder 20 is utilized as an oil returning route from the rocker arm chamber 76 of the rear cylinder 20. An oil returning passage 180 is also formed on an upper end surface of the cylinder head at a position in the vicinity of a left rear end of the rocker arm chamber 76 (a floor surface of the rocker arm chamber). The above oil returning passage 180 is mainly utilized. A guide concave portion 181 extending rear rightward is formed in an upper end opening portion of the oil returning passage 180, and hence the oil is easily collected in the oil returning passage 180. Further, a rib 182 protruding upward extends in the fore-aft direction along the cam chain tunnel 75 on the left side of an upper end opening of the cam chain tunnel 75 on the right side. By the above rib 182, the oil gathered in a bottom surface of the rocker arm chamber 76 is collected not to a side of the cam chain tunnel 75 but to the oil returning passage 180 as much as possible.

In FIG. 13, the oil returning passage 180 for the rear cylinder 20 ranges from an inside of the cylinder head 22 of the rear cylinder 20 to the cylinder 21 and the left crank case member 1*a* and extends downward in a left rear end of the rear cylinder 20 substantially in parallel to a cylinder center line of the rear cylinder 20. A lower end of the oil returning passage 180 curves rearward in a substantially L shape in the left crank case member 1*a* at an upper position of the rear balancer shaft 6*b*. As shown in FIG. 8, an outlet portion 180*a* of a rear end opens in an upper end of the gas-liquid separation chamber 9, and hence the oil is returned to an inside of the gas-liquid separation chamber 9.

It should be noted that the oil flowing into the cam chain tunnel 75 of the rear cylinder 20 in FIG. 12 is returned to a front upper end of the clutch chamber 59 shown in FIG. 9.

(Flow of Lubricating Oil over Entire Engine)

Figure 14:
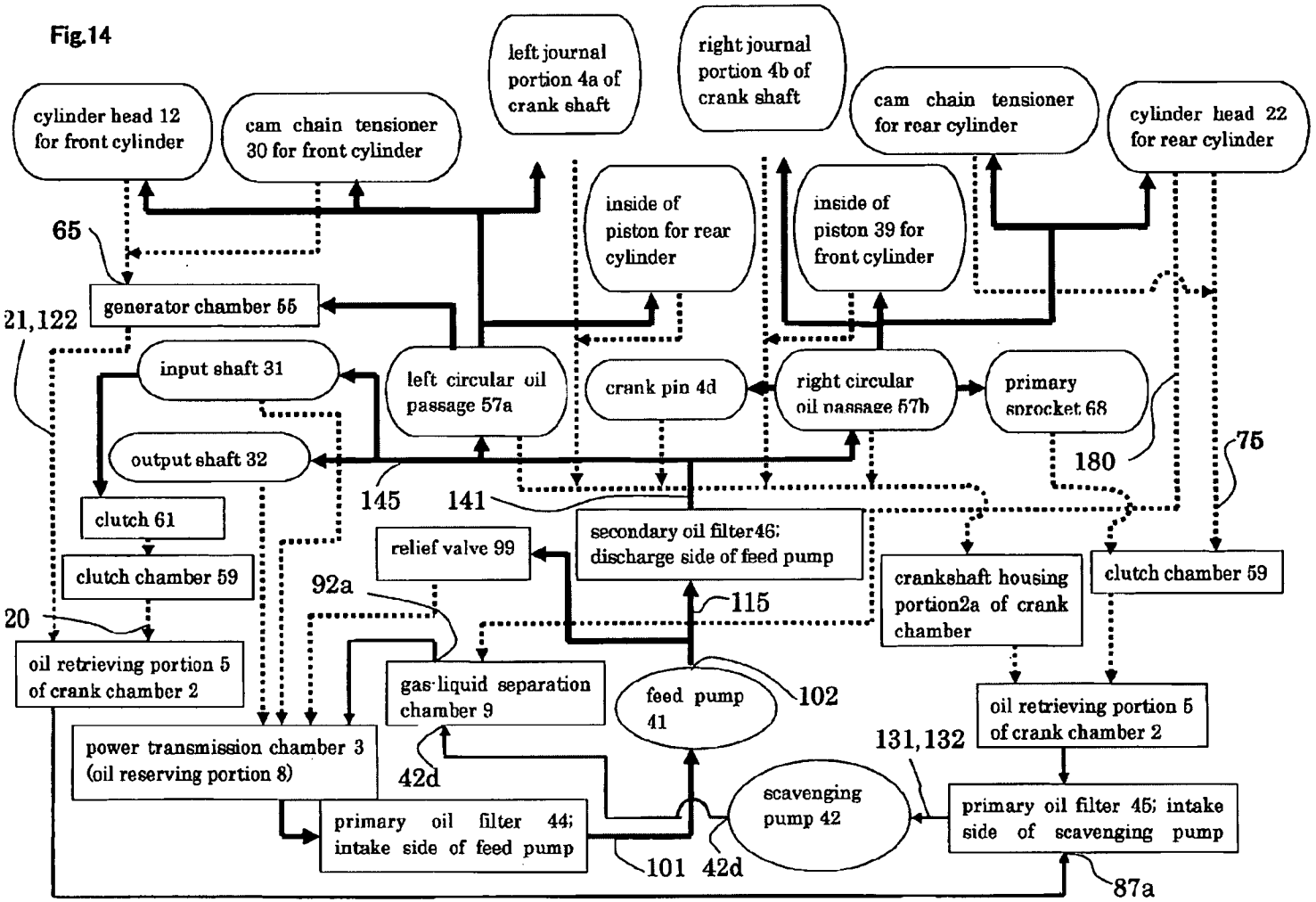
FIG. 14 is a block diagram showing oil flow in the engine.
Figure 15:
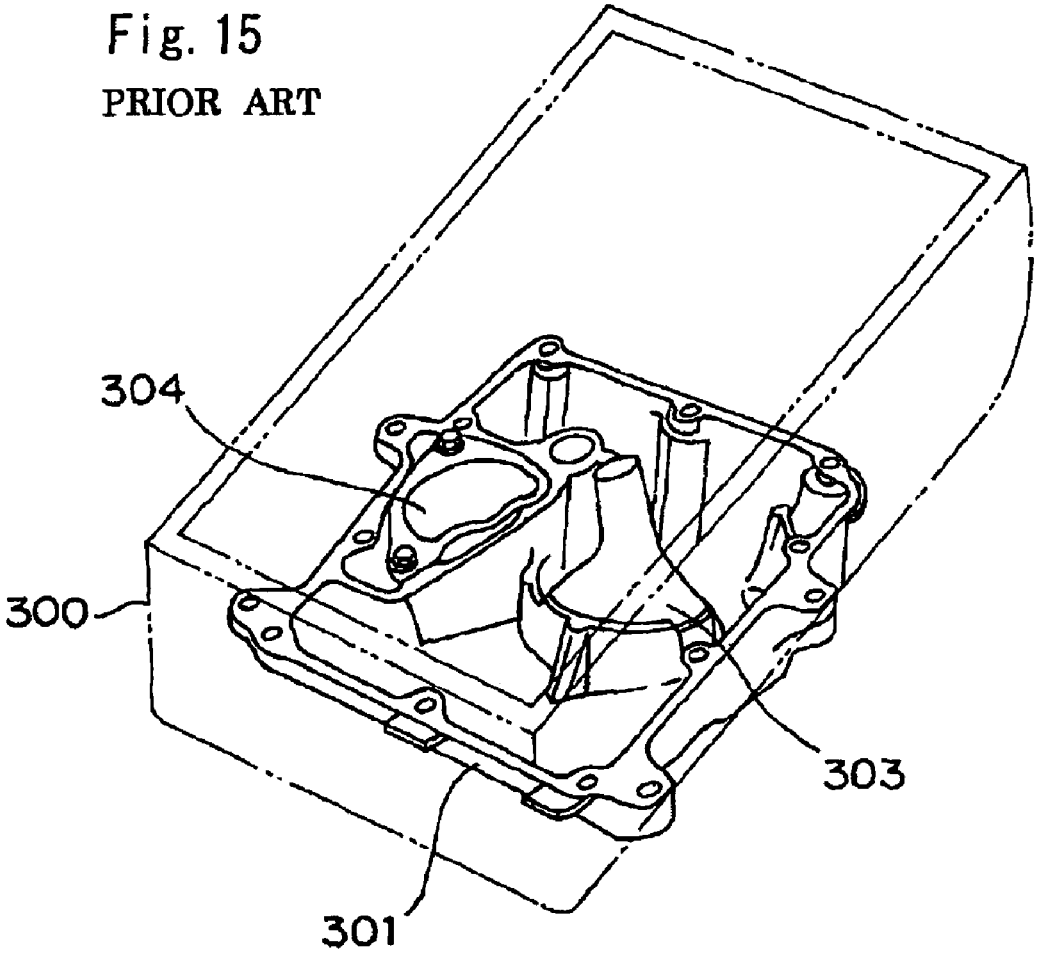
Fig. 15 PRIOR ART
FIG. 15 is a perspective view of an inside of a crank case and an oil pan according to a conventional example.
Figure 16:
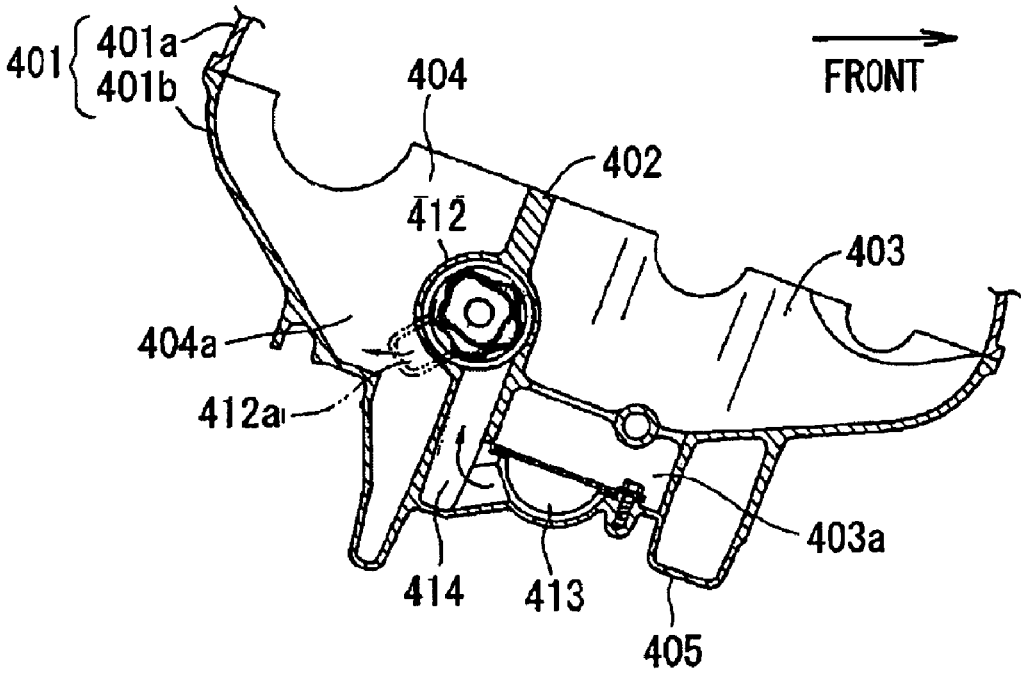
Fig. 16 PRIOR ART
FIG. 16 is a vertically sectional view of a crank case according to another conventional example.

(1) FIG. 14 is a block diagram simply summarizing oil circulation in the engine. Arrows shown by bold lines denote an oil supplying route ranging from the oil reserving portion 8 of the power transmission chamber 3 to the lubricant points via the feed pump 41. Arrows shown by thin lines denote an oil retrieving route ranging from the oil retrieving portion 5 of the crank chamber 2 to the oil reserving portion 8 via the scavenging pump 42. Arrows shown by broken lines denote an oil returning route ranging from the lubricant point to the oil retrieving portion 5 or the oil reserving portion 8.

(2) Oil supply to the lubricant points during the operation of the engine will be briefly described. As shown by the arrows of the bold lines, the feed pump 41 suctions the oil from the oil reserving portion 8 of the power transmission chamber 3 via the first primary oil filter 44 and the oil passage 101 and pressure-feeds the oil to the secondary oil filter 46 via the oil passage 102 and the oil pipe 115 in the oil retrieving portion 5. In the middle of the oil passage 102, the extra oil regulated by the relief valve 99 is directly discharged to the oil reserving portion 8 (the extension portion 8*a*).

(3) The oil filtered by the secondary oil filter 46 passes through the oil passage (the main gallery) 141 and the like and is supplied to the circular oil passages 57*a* and 57*b* of the left and right bearing holes 64*a* and 64*b* and also to the transmission input shaft 31 and the transmission output shaft 32 through the transmission oil pipe 145 and the like. The oil is also supplied from the transmission input shaft 31 to a clutch 61.

(4) From the right circular oil passage 57*b*, the oil is supplied to the right journal portion 4*b* of the crankshaft 4 and also to the crank pin 4*d*, the primary sprocket 68, the inside of the piston 39 for the front cylinder (the oil jet), a cam chain tensioner for the rear cylinder, the cylinder head 22 for the rear cylinder (the rocker arm chamber 76) and the like. Meanwhile, from the left circular oil passage 57*a*, the oil is supplied to the left journal portion 4*a* of the crankshaft 4 and also to the inside of the piston for the rear cylinder (the oil jet), the cylinder head 12 for the front cylinder (the rocker arm chamber 66), the cam chain tensioner 30 for the front cylinder, the generator chamber 55 and the like.

(5) The oil already utilized for lubricating and cooling the gear groups G1 and G2 of the transmission input shaft 31 and the transmission output shaft 32 is directly dropped or flows down to the oil reserving portion 8 of the power transmission chamber 3. The oil already utilized for lubricating and cooling the clutch 61 is dropped or flows down to the clutch chamber 59 and discharged from the clutch chamber 59 to the oil retrieving portion 5.

(6) The oil already utilized for lubricating and cooling the left and right journal portions 4*a* and 4*b* of the crankshaft, the crank pin 4*d*, the pistons 39 for the front and rear cylinders and the like is dropped or flows down to the crankshaft housing portion of the crank chamber 2 and discharged from the crankshaft housing portion to the oil retrieving portion 5.

(7) The oil supplied to the cylinder head 12 for the front cylinder and the hydraulic cam chain tensioner 30 for the front cylinder is returned to the generator chamber 55 directly or through the cam chain tunnel 65 of the front cylinder 10.

(8) The oil already utilized for lubricating and cooling the cam shaft 26 on an upper surface of the cylinder head 22 of the rear cylinder 20 and the like is partly returned to the clutch chamber 59 through the cam chain tunnel 75 for the rear cylinder but mainly returned to the gas-liquid separation chamber 9 not through the cam chain tunnel 75 but through the oil discharge port 181*a* and the oil returning passage 180. In such a case, as shown in FIG. 12, the guide concave portion 181 extending rear rightward is formed in the oil discharge port 181*a*. Therefore, the oil on the upper surface of the cylinder head 22 is mainly collected to the oil returning passage 180 by the above guide concave portion 181. Further, the rib 182 protruding upward extends in the fore-aft direction along the chain tunnel 75 on the left side of the upper end opening of the cam chain tunnel 75 on the right side. Therefore, by the above rib 182, the oil gathered on the bottom surface of the rocker arm chamber 76 can be collected not to the side of the cam chain tunnel 75 but to the oil returning passage 180 as much as possible. It should be noted that in FIG. 14, the oil supplied to the hydraulic cam chain tensioner for the rear cylinder is returned to the clutch chamber 59 directly or through the cam chain tunnel 75 for the rear cylinder.

(9) The oil returned from the lubricant points to the clutch chamber 59 and the generator chamber 55 is retrieved in the oil retrieving portion 5 through the oil holes 120, 121 and 122 and the like respectively.

(10) The oil retrieved in the oil retrieving portion 5 is suctioned by the scavenging pump 42 via the second primary oil filter 45 and returned from the oil inlet (the pump discharge port) 42*d* of the gas-liquid separation chamber 9 shown in FIG. 4 to the lower end of the gas-liquid separation chamber 9. The oil temporarily gathered in the gas-liquid separation chamber 9 is pushed up by the oil successively flowing in, passes through the constricted part 9*a* and overflows from the oil discharge port 92*a* in an upper end, and thereby returned to the oil reserving portion 8 of the power transmission chamber 3.

(Attachment and Detachment Work of Primary Oil Filters 44 and 45)

In a case where the first primary oil filter 44 on the oil intake side of the feed pump 41 shown in FIG. 6 is attached, in FIG. 11, the first primary oil filter 44 is inserted from the oil filter attachment port 123 formed on a left side surface of the left crank case member 1*a* into the first oil filter retaining portion 86 together with the coil spring 105 and the circular spring receiver 109, and the oil filter cap 47 is fitted onto the first oil filter retaining portion 86 from the left side and screwed into the female screw portion 126. Thereby, the coil spring 105 is compressed by the right end of the oil filter cap 47, the right end opening portion of the primary oil filter 44 is sealed, and the primary oil filter 44 is fixed. A clearance between the oil filter cap 47 and a cap attachment base around the oil filter attachment port 123 is sealed by the O-ring 73.

Meanwhile, in a case where the second primary oil filter 45 on the oil intake side of the scavenging pump 42 shown in FIG. 4 is attached, in FIG. 11, the second primary oil filter 45 is inserted from the oil filter attachment port 124 on the right side into the second oil filter retaining portion 87 together with the coil spring 106 and the circular spring receiver 110, and the oil filter cap 48 is fitted onto the second oil filter retaining portion 87 and screwed into the female screw portion 126. Thereby, the coil spring 106 is compressed by the left end of the oil filter cap 48, the left end opening portion of the primary oil filter 45 is sealed, and the primary oil filter 45 is fixed.

(Action of Primary Oil Filters 44 and 45)

In FIG. 11, during the operation of the engine, the first primary oil filter 44 suctions the oil in the oil reserving portion 8 from the slit-shaped oil intake port 86*a* opening rearward, and brings the oil inward through the outer peripheral cylindrical surface so as to filter the oil. The filtered oil is suctioned by the feed pump 41 in FIG. 2 from an opening portion of the right end through the oil filter outlet portion 127 in the right crank case member 1*b*.

In FIG. 11, during the operation of the engine, the second primary oil filter 45 suctions the oil in the oil retrieving portion 5 from the slit-shaped intake port 87*a* opening forward, and brings the oil inward through the outer peripheral cylindrical surface so as to filter the oil. The filtered oil is suctioned by the scavenging pump 42 in FIG. 2 from an opening portion of the left end through the oil filter outlet portion 128 in the left crank case member 1*a*.

(Effect in the Present Embodiment)

There are the following effects with regard to a configuration corresponding to a first feature.

(1) In FIG. 11, both the primary oil filters 44 and 45 are respectively installed from the left and right oil filter attachment ports 123 and 124 of the crank case 1. Therefore, it is possible to easily attach both the primary oil filters 44 and 45 to an inside of the crank case 1 without splitting the left and right crank case members 1*a* and 1*b*.

(2) Since both the primary oil filters 44 and 45 have the substantially same structure, there is no need for distinguishing both the primary oil filters 44 and 45 at the time of attaching both the primary oil filters 44 and 45 and hence it is possible to install both the primary oil filters 44 and 45 to any of the oil filter retaining portions 86 and 87. Thereby, parts are easily produced and managed and there is no fear of selecting a wrong attachment point at an oil filter attachment work.

(3) Both the primary oil filters 44 and 45 are formed in a substantially cylindrical shape, arranged in substantially parallel to the crankshaft 4, and arranged so as to come close to each other in the fore-aft direction. Therefore, it is possible to compactify size of the crank case 1 in the fore-aft direction.

(4) Both the primary oil filters 44 and 45 are respectively inserted from the left and right sides of the crank case 1, and fixed by the oil filter caps 47 and 48 from the left and right sides. Therefore, arrangement space for both the oil filter caps 47 and 48 is easily ensured and the primary oil filters 44 and 45 can be compactly arranged so as to be close to each other in the fore-aft direction as much as possible.

(5) Both the primary oil filters 44 and 45 are respectively inserted from the left and right sides of the crank case 1, the oil passage 101 communicating with an oil filter outlet portion of the first primary oil filter 44 is formed in the right crank case member 1*b*, and the oil passage 132 communicating with an oil filter outlet portion of the second primary oil filter 45 and the like are formed in the left crank case member 1*a*. Therefore, it is possible to separately provide the oil passages 101 and 132 and the like into the left and right crank case members 1*a* and 1*b* so as to ensure large formation space of the oil passages 101 and 132, and hence manufacture of the crank case 1 is easily performed by casting or the like.

(6) Both the primary oil filters 44 and 45 are formed in a substantially cylindrical shape. Therefore, in comparison to a case where tabular shape oil filters are attached, it is possible to attach both the primary oil filters 44 and 45 irrespective of attachment postures (rotation states around cylindrical cores).

(7) The substantially cylindrical primary oil filters 44 and 45 have a structure in which the oil is taken in from an outer periphery and discharged from a front end of an inner peripheral portion in the longitudinal direction. Therefore, it is possible to easily achieve communication between the oil outlet portions of the front ends of the primary oil filters 44 and 45 in the longitudinal direction and the oil passages 101 and 132 and the like formed in the crank case members 1*a* and 1*b*.

(8) The first and second oil filter retaining portions 86 and 87 are formed in a substantially cylindrical shape. Therefore, it is possible to easily form the oil filter retaining portions 86 and 87 themselves and the intake ports 86*a* and 87*b* thereof. An insertion work of the primary oil filters 44 and 45 is also easily performed.

(9) The crank case 1 is divided into the left and right crank case members 1*a* and 1*b*, and both the substantially cylindrical oil filter retaining portions 86 and 87 are formed in the crank case members 1*a* and 1*b* so that the longitudinal direction thereof is substantially parallel to the crankshaft 4. Therefore, when the left and right crank case members 1*a* and 1*b* are manufactured, it is possible to easily mold the oil filter retaining portions 86 and 87 respectively. Moreover, the first oil filter retaining portion 86 is arranged on the side of the oil reserving portion 8 relative to the second oil filter retaining portion 87. Therefore, only by opening the intake ports 86*a* and 87*a* in the peripheral walls of both the oil filter retaining portions 86 and 87, it is possible to easily achieve communication between the oil filter retaining portions 86 and 87 and the oil reserving portion 8 and the oil retrieving portion 5. The intake ports 86*a* and 87*a* are formed in the center part in the left and right direction so as to include the matching surface between the left and right crank case members 1*a* and 1*b*. Therefore, it is possible to form both the intake ports 86*a* and 87*a* at the time of molding the left and right crank case members 1*a* and 1*b* of the crank case 1.

(10) The feed pump 41 and the scavenging pump 42 have the common pump shaft 36 in substantially parallel to the crankshaft 4 and aligned in the crankshaft direction, and both the primary oil filters 44 and 45 are arranged at substantially lower positions of both the pumps 41 and 42. Therefore, it is possible to compactly form a communication structure between the pumps 41 and 42 and the primary oil filters 44 and 45

There are the following effects with regard to a configuration corresponding to a second feature.

(1) In FIG. 6, after the oil gathered or returned in the crank chamber 2 is once housed in a static state in the oil retrieving portion 5 on the lower side of a crankshaft housing portion 2*a*, the oil in the oil retrieving portion 5 is suctioned by the scavenging pump 42 and discharged to the power transmission chamber 3 via the gas-liquid separation chamber 9. Therefore, the scavenging pump 42 can suppress an influence of a pressure change in the crankshaft housing portion 2*a* and suction the oil in the oil retrieving portion 5, and it is possible to sufficiently exercise a suctioning ability of the scavenging pump 42.

(2) In FIG. 6, since the oil in the crank chamber 2 is once discharged to the oil retrieving portion 5, agitation resistance of the crankshaft in the crankshaft housing portion 2*a* is decreased and bubbles are not easily generated in the oil. Thereby, it is possible to reduce air entrainment of the scavenging pump 42 and improve pump efficiency of the scavenging pump 42. It is also possible to decrease the bubbles in the oil discharged to the side of the power transmission chamber 3 so as to improve oil supply efficiency to the lubricant point by the feed pump 41.

(3) In FIG. 6, dead space in a lower end of the crank chamber 2 is utilized as the oil retrieving portion 5 and also utilized as arrangement space for the oil pipe 115. Therefore, it is possible to effectively utilize space in the crank case so as to suppress an increase in size of the crank case.

(4) In FIG. 7, the connecting tube portions 115*a* and 115*b* substantially orthogonal to the longitudinal direction of the oil pipe 115 are provided in the front and rear ends of the oil pipe 115 extending in the fore-aft direction as joints. Meanwhile, as shown in FIG. 6, the tubular oil pipe connecting portions 111 and 112 opening leftward are formed in the front and rear ends of a side wall portion (a right side wall portion) of the oil retrieving portion 5 as an oil outlet and an oil inlet for the oil pipe 115. The oil pipe 115 is attached by fitting the connecting tube portions 115*a* and 115*b* to the oil pipe connecting portions 111 and 112 from the left side. Therefore, an attachment work of the oil pipe 115 can be easily performed from the side of the right crank case member 1*b*. Moreover, both the oil pipe connecting portions 111 and 112 are formed only in the right crank case member 1*b* of the crank case 1 divided in the left and right direction. Therefore, an assembling work of the oil pipe 115 is more easily performed.

(5) In FIG. 7, the secondary oil filter 46 is arranged in a lower part of the front end of the crank case 1 and the oil pipe 115 for achieving communication between the secondary oil filter 46 and a discharge portion of the feed pump 41 is arranged in the oil retrieving portion 5. Therefore, it is possible to arrange the oil pipe 115 in a substantially straight and short manner so as to compactify the oil pipe 115 and also reduce resistance of the oil against passages.

(6) In FIG. 6, the communication hole 97 formed between the partition walls 95 and 96 between the crankshaft housing portion 2*a* of the crank chamber 2 and the oil retrieving portion 5 opens so as to face oil flow moving over an upper surface of the rear partition wall 96 in an arrow A direction by rotation of the crank arm of the crankshaft 4 in an arrow R direction. Therefore, it is possible to promptly discharge the oil flowing over the upper surface of the rear partition wall 96 to the oil retrieving portion 5 without bubbling so as to prevent a decrease in an output by oil agitation.

(7) In FIG. 7, the secondary oil filter 46 is arranged not on left and right side surfaces of the crank case 1 but on a front end surface. Therefore, interference with other parts arranged around the crank case is easily avoided and layout freedom for various parts around the crank case is increased.

(8) In FIG. 6, the communication hole 97 is arranged in the vicinity of the front end of the oil retrieving portion 5 and the oil intake port 87*a* of the second oil filter retaining portion 87 opens in the rear end of the oil retrieving portion 5. Therefore, it is possible to increase a distance between the communication hole 97 and the oil intake port 87*a* of the second oil filter retaining portion 87 as much as possible so as to facilitate heat exchange with the oil in the oil pipe 115.

There are the following effects with regard to a configuration corresponding to a third feature.

(1) In FIG. 13, the oil already used for lubricating and cooling in the rocket arm chamber 76 of the rear cylinder 20 is mainly returned from the upper surface of the cylinder head 22 to the power transmission chamber 3 (the oil reserving portion 8) via the oil discharge port 181*a*, the oil returning passage 180 and the gas-liquid separation chamber 9 in FIG. 8. Therefore, an influence of the scavenging pump 42 is not received in a middle of returning to the power transmission chamber 3, and air mixture into the oil can be prevented. Thereby, it is possible to reduce the air entrainment by the feed pump 41.

(2) In FIG. 1, the oil returned from the upper surface of the cylinder head 22 of the rear cylinder 20 is mainly returned to the power transmission chamber 3 without passing through the scavenging pump 42. Therefore, it is possible to downsize the scavenging pump 42.

(3) In FIG. 12, the cam chain tunnel 75 of the rear cylinder 20 is formed on the right side and the oil discharge port 181*a* and the oil returning passage 180 are formed on the left side. Therefore, the oil can be discharged from both the cam chain tunnel 75 and the oil discharge port 181*a* on the opposite side. Thus, it is possible to efficiently discharge the oil over the entire upper surface of the cylinder head 22 so as to improve oil discharge efficiency.

(4) In FIG. 12, the guide concave portion 181 for guiding the oil to the oil discharge port 181*a* is formed on the upper surface of the cylinder head 22. Therefore, it is possible to improve a discharge amount and speed of the oil from the oil discharge port 181*a* so as to improve the oil discharge efficiency.

(5) In the two-wheeled motor vehicle, the side stand is arranged on the left side of the vehicle body in general. When the vehicle body is supported by the side stand, the vehicle body is inclined to the left side and the oil on the upper surface of the cylinder head 22 is not easily discharged from the cam chain tunnel 75. However, the oil discharge port 181*a* shown in FIG. 12 is arranged in an end on the side where the side stand is arranged (the left side). Therefore, in a state that the vehicle body is supported by the side stand, the oil on the upper surface of the cylinder head 22 of the rear cylinder 20 is naturally collected to the oil discharge port 181*a* so as to be discharged from the oil discharge port 181*a*.

(6) In FIG. 6, the relief valve 99 connected to the discharge side of the feed pump 41 is arranged in the extension portion 8*a* of the oil reserving portion 8 of the power transmission chamber 3. Therefore, it is possible to directly return the oil overflowing from the relief valve 99 to the power transmission chamber 3. That is, the oil is quickly returned to the power transmission chamber 3 and the influence of the scavenging pump 42 is not received. Thereby, it is possible to improve an effect of preventing air entrainment of the feed pump 41.

There are the following effects with regard to a configuration corresponding to a fourth feature.

(1) In FIG. 6, the oil suctioned by the scavenging pump 42 from the oil retrieving portion 5 of a lower part of the crank chamber 2 is not directly discharged to the power transmission chamber 3 but once discharged to the lower end of the gas-liquid separation chamber 9, pushed up in the gas-liquid separation chamber 9 and then discharged from the oil discharge port 92*a* formed in the upper end of the gas-liquid separation chamber 9 to the power transmission chamber 3. Therefore, it is possible to bleed the air in the oil by leaving the oil in the gas-liquid separation chamber 9 for a fixed time and pushing up the oil. Thus, after returning the oil to the oil reserving portion 8, when the oil in the oil reserving portion 8 of the power transmission chamber 3 is suctioned by the feed pump 41, the air entrainment is prevented, and it is possible to improve the pump efficiency and the oil supply efficiency to the lubricant point.

(2) In FIG. 6, the existing first division wall 91 for isolating the crank chamber 2 from the power transmission chamber 3 is utilized so as to form the gas-liquid separation chamber 9 with the second division wall 92. Therefore, it is possible to reduce the number of the parts, easily manufacture the crank case and simplify the crank case.

(3) In FIG. 6, the gas-liquid separation chamber 9, when seen from the crankshaft direction, has the constricted part 9*a* having a smaller horizontal sectional area in a part from the lower end on the oil inlet side to the oil discharge port 92*a* on the upper side. Therefore, since the oil passes through the constricted part 9*a* in a process of pushing up the oil discharged to the lower end in the gas-liquid separation chamber 9, it is possible to collect a number of small bubbles and hence form large bubbles for example so as to promptly release the air from the oil in the upper end of the gas-liquid separation chamber 9, and an air bleeding effect is more improved. A capacity of the gas-liquid separation chamber 9 is limited by having the constricted part 9*a*. Therefore, it is possible to ensure that an oil amount gathered in the oil reserving portion 8 of the power transmission chamber 3 is not a predetermined amount or less.

(4) As in FIGS. 7 and 8, the crank case 1 is divided into the two crank case members 1*a* and 1*b* in the crankshaft direction, the first and second division walls 91 and 92 are formed integrally with the crank case 1, and the oil discharge port 92*a* is formed on the matching surface between the left and right crank case members 1*a* and 1*b*. Therefore, it is possible to easily form the division walls 91 and 92 and the oil discharge port 92*a* together with the crank case members 1*a* and 1*b* at the time of manufacturing the crank case members 1*a* and 1*b* of the crank case 1.

(5) In FIG. 6, a housing of the scavenging pump 42, that is, the common pump housing portion 80 for both the oil pumps is formed integrally with the crank case 1 and also formed integrally and continuously with at least a part of the second division wall 92. Therefore, it is possible to easily form the pump housing portion 80 together with the crank case 1 at the time of manufacturing the crank case 1. Moreover, it is also possible to easily form piping ranging from the scavenging pump 42 to the gas-liquid separation chamber 9 only by forming the oil inlet also serving as the pump discharge port 42*d* as in FIG. 4.

(6) In FIG. 6, the relief valve 99 is connected to the oil passage 102 on the discharge side of the feed pump 41, and the relief route for guiding the oil released from the relief valve 99 to the power transmission chamber, that is, the extension portion 8*a* of the oil reserving portion 8 is formed. Therefore, it is possible to directly return the extra oil discharged from the relief valve 99 to the power transmission chamber 3 so as to prevent mixture of the bubbles into the oil and contribute to air entrainment prevention of the feed pump 41.

(7) In FIG. 6, the first oil filter retaining portion 86 for retaining the primary oil filter 44 of the feed pump 41 is formed at a position rearward displaced from a position immediately beneath the second division wall 92, and the oil intake port 86*a* opens rearward in the oil reserving portion 8. Therefore, for example, the oil overflowing from the oil discharge port 92*a* in the upper end of the gas-liquid separation chamber 9 and flowing down along a rear surface of the second division wall 92 is not promptly suctioned from the oil intake port 86*a*. Thereby, it is possible to contribute to the air entrainment prevention of the feed pump 41.

(8) In FIG. 6, the scavenging pump 42 arranged in the lower end of the gas-liquid separation chamber 9 for pumping the oil up to the inside of the gas-liquid separation chamber 9 is arranged on the lower side of the crankshaft 4 and the transmission input shaft 31, and the oil discharge port 92*a* formed in the upper end of the gas-liquid separation chamber 9 is positioned higher than the shaft center of the crankshaft 4 and the shaft center of the transmission input shaft 31. Therefore, it is possible to bring the oil inlet (the pump discharge port) 42*d* and the oil discharge port 92*a* of the gas-liquid separation chamber 9 away from each other in the up and down direction as much as possible. Thereby, it is possible to increase a time during which the oil is gathered in the gas-liquid separation chamber 9 so as to improve a gas-liquid separation function.

(9) In FIG. 6, a front end of the oil reserving portion 8 extends in dead space on the lower side of both the oil pumps 41 and 42 so as to form the extension portion 8*a*. Therefore, it is possible to increase the gathered oil amount without increasing the size of the crank case 1.

(10) As in FIG. 6, in a structure in which the constricted part 9*a* is formed in the middle of the gas-liquid separation chamber 9, the shape of the first division wall 91 from the intersection point Y1 between the first division wall 91 and the second division wall 92 to the point Y2 corresponding to the constricted part 9*a* on the upper side always shows the upward inclination toward the rear side, and becomes an arc shape coming close to the second division wall 92 toward the upper side. Therefore, the air is not gathered in the middle at the time of pushing the bubbles in the oil up to the constricted part 9*a*, and it is possible to push substantially all the bubbles up to the upper side of the constricted part 9*a*. That is, the air is not gathered in the gas-liquid separation chamber 9.

[Other Embodiments]

(1) In the above embodiments, the crank case has a dually-divided structure in the crankshaft direction. However, it is possible to divide the crank case into three or more. It is also possible to apply to an engine provided with three or more oil pumps.

(2) A shape of the primary oil filters is not limited to a substantially cylindrical shape but can be a tubular shape with a multangular section or a partially cylindrical shape. In a case where the crank case members 1*a* and 1*b* divided into the left and right sides are molded by die-casting in accordance with a change in a sectional shape or the like of the primary oil filters, the shape may be a partially cylindrical shape, or a tubular shape with a rectangular section or a multangular section in addition to a cylindrical shape.

(3) The first primary oil filter may be inserted from the right side of the crank case and the second primary oil filter may be inserted from the left side of the crank case.

(4) It is possible to apply to an engine in which the first and second oil filters, that is, the feed pump and the scavenging pump respectively have separate pump shafts. The oil pumps are not limited to the trochoid type pump and various types of oil pumps such as a gear pump may be used.

(5) In the above embodiment, the oil already used for lubricating the cam shaft on the upper surface of the cylinder head 22 of the rear cylinder 20 and the like is returned to the power transmission chamber 3 via the oil returning passage 180 and the gas-liquid separation chamber 9, and the gas-liquid separation chamber 9 is also utilized as a part of the oil returning route. However, it is possible to directly return the oil from the oil returning passage 180 to the power transmission chamber 3 without passing through the gas-liquid separation chamber 9.

(6) The present invention is not limited to the lubricant structure of the engine for the two-wheeled motor vehicle but can be applied to a lubricant structure of an engine for various vehicles or an industrial engine and also to an engine other than the V type engine.

(7) It is possible to perform various modifications and variations without departing from a spirit and a scope of the present invention described in claims.

What is claimed is:

1. A lubricant structure of an engine, comprising:

a power transmission chamber formed as an oil reserving portion, in a crank case divided in a crankshaft direction;

a first oil pump for pressure-feeding oil of the oil reserving portion to a plurality of lubricant points;

a second oil pump for returning the oil returned to a crank chamber to the power transmission chamber;

a first oil filter connected to an intake side of the first oil pump; and a second oil filter connected to an intake side of the second oil pump, wherein oil filter attachment ports are respectively formed in crank case members forming the crank case on both sides in the crankshaft direction, the first oil filter is inserted into the crank case from the oil filter attachment port of one of the crank case members, the second oil filter is inserted into the crank case from the oil filter attachment port of the other crank case member, and the first oil filter and the second oil filter are formed in a substantially same shape.

2. The lubricant structure of the engine according to claim 1, wherein substantially-cylindrical first and second oil filter retaining portions respectively communicating with the oil filter attachment ports are formed integrally with the crank in the crank case, an intake port opening in a lower end of the oil reserving portion is formed in the first oil filter retaining portion for retaining the first oil filter, and an intake port opening in a lower end of the crank chamber is formed in the first oil filter retaining portion for retaining the second oil filter.

3. The lubricant structure of the engine according to claim 2, wherein the first oil filter retaining portion and the second oil filter retaining portion are formed so that a longitudinal direction of the oil filter retaining portions is substantially parallel to the crankshaft, and the first oil filter retaining portion is arranged so as to be placed on a side of the oil reserving portion relative to the second oil filter retaining portion.

4. The lubricant structure of an engine, comprising:

a power transmission chamber formed as an oil reserving portion in a crank case;

a first oil pump for pressure-feeding oil of the oil reserving portion to a plurality of lubricant points;

a second oil pump for returning the oil returned to a crank chamber to the power transmission chamber;

a first oil filter connected to an intake side of the first oil pump; and a second oil filter connected to an intake side of the second oil pump, wherein at least two oil filter attachment ports are formed in the crank case, the first oil filter is inserted into the crank case from one of the oil filter attachment ports of the crank case, the second oil filter is inserted into the crank case from the other of the oil filter attachment ports of the crank case, the first oil pump and the second oil pump are attached to a common pump shaft which is substantially parallel to the crankshaft in the crankshaft direction, and the first and second oil filters are arranged at substantially lower positions of both the oil pumps.

5. A lubricant structure of an engine, comprising:

a power transmission chamber formed as an oil reserving portion in a crank case;

a first oil pump for pressure-feeding oil of the oil reserving portion to a plurality of lubricant points;

a second oil pump for returning the oil returned to a crank chamber to the power transmission chamber;

a first oil filter connected to an intake side of the first oil pump; and a second oil filter connected to an intake side of the second oil pump, wherein at least two oil filter attachment ports are formed in the crank case, the first oil filter is inserted into the crank case from one of the oil filter attachment ports of the crank case, the second oil filter is inserted into the crank case from the other of the oil filter attachment ports of the crank case, the crank chamber is partitioned by a partition wall into a crankshaft housing portion for housing the crankshaft, and an oil retrieving portion located under the crankshaft housing portion communicating with an intake portion of the second oil pump, a communication hole for achieving communication between the crankshaft housing portion and the oil retrieving portion so as to distribute the oil is formed in the partition wall, and an oil pipe for pressure-feeding the oil discharged from the first oil pump to a secondary oil filter provided in the crank case is arranged in the oil retrieving portion.

6. The lubricant structure of the engine according to claim 5, wherein an end of the oil pipe in a longitudinal direction has a tubular joint substantially orthogonal to the longitudinal direction of the oil pipe, and the joint is fitted and connected to an oil port part formed in a side wall portion of the oil retrieving portion.

7. The lubricant structure of the engine according to claim 6, wherein the oil pipe has the joints in both ends in the longitudinal direction, and both the joints are connected to the oil port parts formed in one of the dually-divided crank case members.

8. The lubricant structure of the engine according to claim 5, wherein the communication hole opens so as to face oil flow moving over an upper surface of the partition wall by rotation of the crankshaft.

9. The lubricant structure of the engine according to claim 5, wherein an oil intake port communicating with the intake side of the second oil pump opens in the oil retrieving portion, and the oil intake port is arranged in or in a vicinity of an end of the oil retrieving portion and the communication hole is arranged in or in a vicinity of the other end of the oil retrieving portion.

10. A lubricant structure of an engine, comprising:

a power transmission chamber formed as an oil reserving portion in a crank case;

a first oil pump for pressure-feeding oil of the oil reserving portion to a plurality of lubricant points;

a second oil pump for returning the oil returned to a crank chamber to the power transmission chamber;

a first oil filter connected to an intake side of the first oil pump; and a second oil filter connected to an intake side of the second oil pump, wherein at least two oil filter attachment ports are formed in the crank case, the first oil filter is inserted into the crank case from one of the oil filter attachment ports of the crank case, the second oil filter is inserted into the crank case from the other of the oil filter attachment ports of the crank case, the crank case combines front and rear cylinders arranged in a V shape, an oil discharge port is formed on an upper surface of a cylinder head of the rear cylinder, and an oil returning route ranging from the oil discharge port to the power transmission chamber without passing through an inside of the crank chamber and the second oil pump is formed in the cylinder head, the cylinder and the crank case.

11. The lubricant structure of the V-type engine according to claim 10, wherein the oil discharge port is arranged on an opposite side of a side where a cam chain tunnel of the rear cylinder is formed in the crankshaft direction.

12. The lubricant structure of the engine according to claim 10, wherein a guide for guiding the oil of the cylinder head to the oil discharge port is formed on the upper surface of the cylinder head of the rear cylinder.

13. The lubricant structure of the engine according to claim 10, wherein the engine is for a two-wheeled motor vehicle, and the oil discharge port is formed in an end on a side where a vehicle body is inclined when the vehicle body is supported by a side stand.

14. The lubricant structure of the engine according to claim 10, wherein a relief valve connected to a discharge side of the first oil pump is arranged in the power transmission chamber.

15. A lubricant structure of an engine, comprising:

a power transmission chamber formed as an oil reserving portion in a crank case divided in a crankshaft direction;

a first oil pump for pressure-feeding oil of the oil reserving portion to a plurality of lubricant points;

a second oil pump for returning the oil returned to a crank chamber to the power transmission chamber;

a first oil filter connected to an intake side of the first oil pump; and a second oil filter connected to an intake side of the second oil pump, wherein oil filter attachment ports are respectively formed in crank case members forming the crank case on both sides in the crankshaft direction, the first oil filter is inserted into the crank case from the oil filter attachment port of one of the crank case members, the second oil filter is inserted into the crank case from the oil filter attachment port of the other crank case member, the power transmission chamber is isolated from the crank chamber by a first division wall, a second division wall is formed in the power transmission chamber so that a gas-liquid separation chamber is formed between the second division wall and the first division wall, an oil inlet communicating with a discharge portion of the second oil pump is formed in the gas-liquid separation chamber, and an oil discharge port for discharging the oil from the gas-liquid separation chamber to the power transmission chamber is formed at a position higher than the oil inlet in the second division wall.

16. The lubricant structure of the engine according to claim 15, wherein the gas-liquid separation chamber has a constricted part having a smaller horizontal sectional area in a part from the oil inlet to the oil discharge port on an upper side.

17. The lubricant structure of the engine according to claim 15, wherein the first and second division walls are formed integrally with the crank case, the crank case has a pair of crank case members dually divided in the crankshaft direction, and the oil discharge port is formed on a matching surface between both the crank case members.

18. The lubricant structure of the engine according to claim 15, wherein a relief valve is connected to an oil passage on a discharge side of the first oil pump, and a relief route for guiding the oil released from the relief valve to the power transmission chamber is formed.

19. The lubricant structure of the engine according to claim 15, wherein an oil intake port opening in the power transmission chamber and communicating with a pump intake port of the first oil pump is formed in a lower end of the power transmission chamber, and the oil intake port opens at a position displaced from a position immediately beneath the second division wall.

* * * * *